US009279433B2

(12) United States Patent
Penning

(10) Patent No.: US 9,279,433 B2
(45) Date of Patent: Mar. 8, 2016

(54) POPPET VALVE ASSEMBLY FOR CONTROLLING A PNEUMATIC ACTUATOR

(75) Inventor: Bruce R. Penning, Louisville, KY (US)

(73) Assignee: General Equipment and Manufacturing Company, Inc., Louisville, KY (US)

( * ) Notice: Subject to any disclaimer, the term of this patent is extended or adjusted under 35 U.S.C. 154(b) by 815 days.

(21) Appl. No.: 13/436,785

(22) Filed: Mar. 30, 2012

(65) Prior Publication Data

US 2012/0260993 A1 Oct. 18, 2012

Related U.S. Application Data

(60) Provisional application No. 61/470,993, filed on Apr. 1, 2011.

(51) Int. Cl.

| | |
|---|---|
| ***F15B 13/04*** | (2006.01) |
| ***F15B 13/042*** | (2006.01) |
| ***F15B 11/00*** | (2006.01) |

(52) U.S. Cl.

CPC ..... *F15B 13/0426* (2013.01); *F15B 11/006* (2013.01); *F15B 13/0405* (2013.01); (Continued)

(58) Field of Classification Search

CPC ..... F15B 11/006; F15B 13/0405; F15B 13/0426; F15B 2211/30575; F15B 2211/8855; F15B 2211/355; F15B 2211/8623; F15B 2211/8752; F15B 2211/329; Y10T 37/87169; Y10T 137/87217; Y10T 137/87225; Y10T 137/87233; Y10T 137/87241; Y10T 137/86574; Y10T 137/86622; Y10T 137/8663; Y10T 137/7838; Y10T 137/87837; Y10T 137/86992; Y10T 137/0318; Y10T 137/87877

USPC ..... 137/596, 596.17, 596.18, 596.1, 596.2, 137/625.2, 625.65, 625.66; 91/433, 461

See application file for complete search history.

(56) References Cited

U.S. PATENT DOCUMENTS

| | | | | |
|---|---|---|---|---|
| 3,692,054 | A * | 9/1972 | Buls et al. | 137/596.18 |
| 3,971,398 | A * | 7/1976 | Taylor et al. | 137/624.14 |

(Continued)

FOREIGN PATENT DOCUMENTS

| | | |
|---|---|---|
| EP | 0790 412 A2 | 8/1997 |
| GB | 1 357 411 A | 6/1974 |

(Continued)

OTHER PUBLICATIONS

International Search Report for PCT/US2012/031197, mailed Jun. 11, 2012.

(Continued)

*Primary Examiner* — Craig J Price

(74) *Attorney, Agent, or Firm* — Marshall, Gerstein & Borun LLP

(57) ABSTRACT

A poppet valve assembly to control a pneumatic actuator may include a housing having a central bore. A first module may be disposed within the central bore, and the first module may have a first and second poppet valve. A second module may also be disposed within the central bore, and the second module may have a third and fourth poppet valve. A supply of pressurized fluid may be in fluid communication with a plurality of control valves such that pressurized fluid from the control valves opens and closes the poppet valves. The supply of pressurized fluid may also be in fluid communication with the first module and the second module such that the opening and closing of the poppet valves controls the position of the pneumatic actuator.

16 Claims, 7 Drawing Sheets

(52) U.S. Cl.
CPC . *F15B2211/30575* (2013.01); *F15B 2211/329* (2013.01); *F15B 2211/355* (2013.01); *F15B 2211/8623* (2013.01); *F15B 2211/8752* (2013.01); *F15B 2211/8855* (2013.01); *Y10T 137/0318* (2015.04); *Y10T 137/7838* (2015.04); *Y10T 137/86992* (2015.04); *Y10T 137/87837* (2015.04); *Y10T 137/87877* (2015.04)

(56) References Cited

U.S. PATENT DOCUMENTS

| | | | | |
|---|---|---|---|---|
| 5,117,797 | A * | 6/1992 | Telep et al. | 137/907 |
| 5,261,314 | A | 11/1993 | Kimura | |
| 6,228,019 | B1 * | 5/2001 | Phillips et al. | 137/596.17 |
| 2002/0112623 | A1 * | 8/2002 | Marmin | B41F 13/06 101/228 |

FOREIGN PATENT DOCUMENTS

| | | |
|---|---|---|
| JP | 02154873 | 6/1990 |
| WO | WO-03/010452 A1 | 2/2003 |

OTHER PUBLICATIONS

Written Opinion for PCT/US2012/031197, mailed Jun. 11, 2012.

Office Action for Japanese Application No. 2014-502794 dated Oct. 13, 2015.

Office Action for Chinese Application No. 201110305639.7 dated Oct. 30, 2015.

* cited by examiner

POPPET VALVE ASSEMBLY FOR CONTROLLING A PNEUMATIC ACTUATOR

FIELD OF THE DISCLOSURE

This disclosure relates to an assembly of poppet valves in general, and an assembly of multiple poppet valves that act to control a pneumatic actuator in particular.

BACKGROUND OF THE INVENTION

Electro-pneumatic positioners are mechanical devices that control the position of a pneumatic actuator based on digital input signals provided by a programmable controller, such as a programmable logic controller. Generally, the controller is connected to an I/P (current to pressure) converter, which is in turn connected to one or more control valves. The I/P converter controls the control valves that are each in fluid communication with both a supply of pressurized fluid, such as pressurized air, and one or more volumes within the pneumatic actuator. Based on a command from the controller to the I/P converter, the I/P converter opens the control valve to allow the pressurized fluid from the supply into one of the volumes of the pneumatic actuator. This pressurized air acts on the surface of a piston defining part of the volume within the pneumatic actuator, thereby moving the piston and an actuator arm coupled to the piston into a desired position.

Spool valves and poppet valves are commonly used as control valves in electro-pneumatic applications. Generally, spool designs have a compact form factor due to the linear displacement of a cylindrical spool element within a housing. Poppet valve assemblies can be used in a wide range of operational environments, but can have a larger form factor than spool designs. Poppet valve assemblies generally include a combination of two normally open poppet valves and two normally closed poppet valves. A pair of valve plugs are coupled to a single axially-displaceable shaft to form the first set of normally closed and normally open poppet valves. A second shaft having a second pair of valve plugs forms the second set of normally closed and normally open poppet valves. When each shaft is in a first valve position, the valve plug for the normally closed poppet valve is sealingly engaged with a corresponding valve seat, and the valve plug for the normally open poppet valve is disengaged from a corresponding valve seat. When the shaft is axially displaced to a second shaft position, the valve plug for the normally closed poppet valve is moved to a position such that it is disengaged from the corresponding valve seat, and the valve plug for the normally open poppet valve is moved to a position such that it sealingly engages the corresponding valve seat. When the shaft is axially displaced to return to the first shaft position, the valve plug for the normally closed poppet valve is moved to a position such that it sealingly engages the corresponding valve seat, and the valve plug for the normally open poppet valve is moved to a position such that it is disengaged from the corresponding valve seat. The cycle repeats as the valve shaft is axially reciprocated from the first position to the second position, and back to the first position.

BRIEF SUMMARY OF THE INVENTION

In accordance with one exemplary aspect of the present invention, a poppet valve assembly may include a valve housing having a central bore. A first module may be disposed within the central bore, and the first module may include a first normally closed poppet valve and a second normally closed poppet valve. Each of the first and second normally closed poppet valves may have an open position and a closed position. A central port may be formed in the first module, and the central port of the first module may be adapted to be coupled to a first volume of a pneumatic cylinder. An exhaust port may be formed in the first module such that the central port is in fluid communication with the exhaust port when the first poppet valve is in the open position. A supply port may be formed in the first module such that the central port is in fluid communication with the supply port when second poppet valve is in the open position. The supply port may be configured to be in fluid communication with a supply of pressurized fluid such that when the second poppet valve is in the open position, pressurized fluid is provided to the first volume of the pneumatic cylinder. The exhaust port may be configured to vent pressurized fluid from the first volume of the pneumatic cylinder when the first poppet valve is in the open position.

In accordance with another exemplary aspect of the present invention, the first normally closed poppet valve includes a first volume and the second normally closed poppet valve includes a second volume.

In accordance with yet another exemplary aspect of the present invention, a first poppet port may be formed in the first module. The first poppet port may be in fluid communication with the first volume and adapted to be both an inlet and an outlet for a pressurized fluid. A second poppet port may formed in the first module. The second poppet port may be in fluid communication with the second volume and adapted to be both an inlet and an outlet for a pressurized fluid.

In accordance with still one more exemplary aspect of the present invention, the first poppet valve may include a first diaphragm circumferentially secured to the first module, and the first diaphragm may at least partially define the first volume. A first valve plug may be coupled to the first diaphragm, and a first valve seat may be formed in a first central aperture that is in fluid communication with the central passage. A first spring may be disposed within the first volume that biases the first valve plug into sealing engagement with the first valve seat such that the first poppet valve is normally closed. The second poppet valve may include a second diaphragm circumferentially secured to the first module, and the second diaphragm may at least partially define the second volume. A second valve plug may be coupled to the second diaphragm, and a second valve seat may be formed in a second central aperture that is in fluid communication with the central passage. A second spring may be disposed within the second volume that biases the second valve plug into sealing engagement with the second valve seat such that the second poppet valve is normally closed.

In accordance with a further exemplary aspect of the present invention, the poppet valve assembly may also include a second module disposed adjacent to the first module within the central bore, and the second module may include a third normally closed poppet valve and a fourth normally closed poppet valve. A central port may be formed in the second module, and the central port of the second module may be adapted to be coupled to a second volume within the pneumatic cylinder. An exhaust port may be formed in the second module such that the central port of the second module is in fluid communication with the exhaust port of the second module when the third poppet valve is in the open position. A supply port may be formed in the second module such that the central port of the second module is in fluid communication with the supply port of the second module when the fourth poppet valve is in the open position. The supply port of the second module may be configured to be in fluid communication with a supply of pressurized fluid such that when the fourth poppet valve is open, pressurized fluid is provided to the second volume within the pneumatic cylinder. The exhaust port of the second module may be configured to vent pressurized fluid from the second volume within the pneumatic cylinder when the third poppet valve is open.

In accordance with another exemplary aspect of the present invention, a third poppet port may be formed in the second module, the third poppet port being in fluid communication with the third volume and adapted to be both an inlet and an outlet for a pressurized fluid. A fourth poppet port may be formed in the second module, the fourth poppet port being in fluid communication with the fourth volume and adapted to be both an inlet and an outlet for a pressurized fluid.

In accordance with yet one more exemplary aspect of the present invention, the third normally closed poppet valve may include a third volume and the fourth normally closed poppet valve may include a fourth volume.

In accordance with a further exemplary aspect of the present invention, the first poppet valve may include a third diaphragm circumferentially secured to the second module, and the third diaphragm may at least partially define the third volume. A third valve plug may be coupled to the third diaphragm and a third valve seat may be formed in a second central aperture that is in fluid communication with the central passage of the second module. A third spring may be disposed within the third volume that may bias the third valve plug into sealing engagement with the third valve seat such that the third poppet valve is normally closed. The fourth poppet valve may include a fourth diaphragm circumferentially secured to the second module, the fourth diaphragm at least partially defining the fourth volume. A fourth valve plug may be coupled to the fourth diaphragm, and a fourth valve seat may be formed in a second central aperture that is in fluid communication with the central passage of the second module. A fourth spring may be disposed within the fourth volume that may bias the fourth valve plug into sealing engagement with the fourth valve seat such that the fourth poppet valve is normally closed.

In accordance with yet one more exemplary aspect of the present invention, the first poppet valve may be configured to be maintained in the closed position by a supply of pressurized fluid introduced into the first volume, and the second poppet valve may be configured to be maintained in the closed position by a supply of pressurized fluid introduced into the second volume.

In accordance with another exemplary aspect of the present invention, the central bore of the housing may be cylindrical. Additionally, the first module may be cylindrical and sized to be received into the cylindrical central bore. Furthermore, the first module and second module may both be cylindrical and sized to be received into the central bore.

In accordance with another exemplary aspect of the present invention, a system for controlling a pneumatic actuator may include a supply of pressurized fluid. A first module may be disposed within a valve housing, and the first module may include a first normally closed poppet valve and a second normally closed poppet valve, wherein each of the first and second poppet valves has an open position and a closed position. A central port may be formed in the first module that is in fluid communication with a first volume of the pneumatic actuator. An exhaust port may be formed in the first module, the exhaust port being in fluid communication with the atmosphere such that the central port, and the first volume of the pneumatic actuator in fluid communication with the central port, is in fluid communication with the atmosphere when the first poppet valve is in the open position, and the central port, and the first volume of the pneumatic actuator in fluid communication with the central port, is not in fluid communication with the atmosphere when the first poppet valve is in the closed position. A supply port may be formed in the first module, the supply port being in fluid communication with the supply of pressurized fluid such that the central port, and the first volume of the pneumatic actuator in fluid communication with the central port, is in fluid communication with the supply of pressurized fluid when second poppet valve is in the open position, and the central port, and the first volume of the pneumatic actuator in fluid communication with the central port, is not in fluid communication with the supply of pressurized fluid when second poppet valve is in the closed position. A first control valve may have a supply port, a work port, and an exhaust port, wherein the supply port of the first control valve is in fluid communication with the supply of pressurized fluid, the work port of the first control valve is in fluid communication with the second poppet valve, and the exhaust port of the first control valve is in fluid communication with the atmosphere. A second control valve may have a supply port, a work port, and an exhaust port, wherein the supply port of the second control valve is in fluid communication with the supply of pressurized fluid, the work port of the second control valve is in fluid communication with the first poppet valve, and the exhaust port of the second control valve is in fluid communication with the atmosphere. The first volume of the pneumatic actuator may be partially defined by a first side of a piston and an interior surface of an actuator body, and an actuator arm may be secured to the piston such that when the supply of pressurized fluid is in fluid communication with the first volume of the pneumatic actuator, a force on the piston caused by the pressurized fluid displaces the actuator arm.

In accordance with a still further exemplary aspect of the present invention, the first control valve may have a first position and a second position, wherein in the first position, the work port of the first control valve may be in fluid communication with the exhaust port of the first control valve. In the second position, the work port of the first control valve may be in fluid communication with the supply port of the first control valve. The second control valve may have a first position and a second position, and in the first position, the work port of the second control valve is in fluid communication with the supply port of the second control valve, and in the second position the work port of the second control valve is in fluid communication with the exhaust port of the second control valve.

In accordance with one more exemplary aspect of the present invention, when the second control valve is in the first position, the first poppet valve may be moved to the closed position by pressurized fluid from the supply. And when the first control valve is in the first position, the second poppet valve may be opened by pressurized fluid from the first volume of the pneumatic actuator acting on a portion of the second poppet valve.

In accordance with yet one more exemplary aspect of the present invention, when the first control valve is in the second position, the second poppet valve may be moved to the closed position by pressurized fluid from the supply, and when the second control valve is in the second position, the first poppet valve may be opened by pressurized fluid from the first volume of the pneumatic actuator acting on a portion of the first poppet valve.

In accordance with a still further exemplary aspect of the present invention, when the first control valve and the second control valve are both in the first position, pressurized fluid may enter the first volume of the pneumatic actuator such that the longitudinal arm is displaced in a first direction. And when the first control valve and the second control valve are both in the second position, pressurized fluid may exit the first volume of the pneumatic actuator such that the longitudinal arm is displaced in a second direction opposite the first direction.

In accordance with a further exemplary aspect of the present invention, the first control valve may be a 3/2 pilot valve and the second control valve may be a 3/2 shuttle valve. Alternatively, the first control valve may be a 3/2 shuttle valve and the second control valve may be a 3/2 pilot valve. Further, the first control valve may be a 3/2 pilot valve and the second control valve may be a 3/2 pilot valve.

In accordance with another exemplary aspect of the present invention, the first normally closed poppet valve may include a first volume, and a first poppet port may be formed in the first module such that the first poppet port is in fluid communication with the first volume. The second normally closed poppet valve may include a second volume, and a second poppet port may be formed in the first module such that the second poppet port is in fluid communication with the second volume.

In accordance with still another exemplary aspect of the present invention, the first poppet valve may include a first diaphragm circumferentially secured to the first module, and the first diaphragm may at least partially define the first volume. A first valve plug may be coupled to the first diaphragm, and a first valve seat may be formed in a first central aperture that is in fluid communication with the central passage. A first spring may be disposed within the first volume that biases the first valve plug into sealing engagement with the first valve seat such that the first poppet valve is normally closed. The second poppet valve may include a second diaphragm circumferentially secured to the first module, and the second diaphragm may at least partially define the second volume. A second valve plug may be coupled to the second diaphragm, and a second valve seat may be formed in a second central aperture that is in fluid communication with the central passage. A second spring may be disposed within the second volume that biases the second valve plug into sealing engagement with the second valve seat such that the second poppet valve is normally closed.

In accordance with one more exemplary aspect of the present invention, the first poppet valve may be closed when pressurized fluid from the supply enters the first volume of the first poppet valve and acts on the first diaphragm such that the first valve plug coupled to the first diaphragm is displaced towards the first valve seat. The first poppet valve may be opened when pressurized fluid within the first volume of the first poppet valve exits the first volume of the first poppet valve, and pressurized fluid from the first volume of the pneumatic actuator acts on the first valve plug and the first diaphragm, resulting in a force that overcomes the biasing force of the first spring, thereby displacing the first valve plug away from the first valve seat.

In accordance with yet another exemplary aspect of the present invention, the second poppet valve may be closed when pressurized fluid from the supply enters the second volume of the second poppet valve and acts on the second diaphragm such that the second valve plug coupled to the second diaphragm is displaced towards the second valve seat. The second poppet valve may be opened when pressurized fluid within the second volume of the second poppet valve exits the second volume of the second poppet valve, and pressurized fluid from the first volume of the pneumatic actuator acts on the first valve plug and the first diaphragm, resulting in a force that overcomes the biasing force of the first spring, thereby displacing the first valve plug away from the first valve seat.

In accordance with another exemplary aspect of the present invention, a second module may be disposed within the valve housing adjacent to the first module. The second module may include a third normally closed poppet valve and a fourth normally closed poppet valve, wherein each of the third and fourth poppet valves has an open position and a closed position. A second central port may be formed in the second module that is in fluid communication with a second volume of the pneumatic actuator. A second exhaust port may be formed in the second module, the second exhaust port being in fluid communication with the atmosphere such that the second central port, and the second volume of the pneumatic actuator in fluid communication with the second central port, is in fluid communication with the atmosphere when the third poppet valve is in the open position, and the second central port, and the second volume of the pneumatic actuator in fluid communication with the second central port, is not in fluid communication with the atmosphere when the third poppet valve is in the closed position. A supply port may be formed in the second module, the supply port being in fluid communication with the supply of pressurized fluid such that the second central port, and the second volume of the pneumatic actuator in fluid communication with the second central port, is in fluid communication with the supply of pressurized fluid when the fourth poppet valve is in the open position, and the second central port, and the second volume of the pneumatic actuator in fluid communication with the second central port, is not in fluid communication with the supply of pressurized fluid when the fourth poppet valve is in the closed position. The work port of the first control valve may be in fluid communication with the third poppet valve, and the work port of the second control valve may be in fluid communication with the fourth poppet valve, and the second volume of the pneumatic actuator may be partially defined by a second side of the piston and the interior surface of an actuator such that when the supply of pressurized fluid is in fluid communication with the second volume of the pneumatic actuator, a force on the piston caused by the pressurized fluid displaces the actuator arm.

In accordance with even one more exemplary aspect of the present invention, when the second control valve is in the first position, the first poppet valve and the fourth poppet valves may be moved to the closed position by pressurized fluid from the supply, and when the first control valve is in the first position, the second poppet valve may be opened by pressurized fluid from the first volume of the pneumatic actuator acting on a portion of the second poppet valve. The third poppet valve may be opened by pressurized fluid from the second volume of the pneumatic actuator acting on a portion of the third poppet valve.

In accordance with still another exemplary aspect of the present invention, when the first control valve is in the second position, the second poppet valve and third poppet valves may be moved to the closed position by pressurized fluid from the supply, and when the second control valve is in the second position, the first poppet valve may be opened by pressurized fluid from the first volume of the pneumatic actuator acting on a portion of the first poppet valve. The fourth poppet valve may be opened by pressurized fluid from the second volume of the pneumatic actuator acting on a portion of the fourth poppet valve.

In accordance with yet one more exemplary aspect of the present invention, when the first control valve and the second control valve are both in the first position, pressurized fluid may enter the first volume of the pneumatic actuator and may exit the second volume of the pneumatic actuator such that the longitudinal arm is displaced in a first direction. And when the first control valve and the second control valve are both in the second position, pressurized fluid may exit the first volume of the pneumatic actuator and enter the second volume of the pneumatic actuator such that the longitudinal arm is displaced in a second direction opposite the first direction.

In accordance with a further exemplary aspect of the present invention, the first control valve may be a 3/2 pilot valve and the second control valve may be a 3/2 shuttle valve. Alternatively, the first control valve may be a 3/2 shuttle valve and the second control valve may be a 3/2 pilot valve. Further, the first control valve may be a 3/2 pilot valve and the second control valve may be a 3/2 pilot valve.

In accordance with a further exemplary aspect of the present invention, the first poppet valve may include a first volume, and a first poppet port may be formed in the first module such that the first poppet port is in fluid communication with the first volume. The second poppet valve may include a second volume, and a second poppet port may be formed in the first module such that the second poppet port is in fluid communication with the second volume. The third poppet valve may include a third volume, and a third poppet port may be formed in the first module such that the third poppet port is in fluid communication with the third volume. The fourth poppet valve may include a fourth volume, and a fourth poppet port may be formed in the first module such that the fourth poppet port is in fluid communication with the fourth volume.

In accordance with another exemplary aspect of the present invention, the first poppet valve may include a first diaphragm circumferentially secured to the first module, and the first diaphragm may at least partially define the first volume. A first valve plug may be coupled to the first diaphragm, and a first valve seat may be formed in a first central aperture that is in fluid communication with the central passage. A first spring may be disposed within the first volume biasing the first valve plug into sealing engagement with the first valve seat such that the first poppet valve is normally closed. The second poppet valve may include a second diaphragm circumferentially secured to the first module, and the second diaphragm may at least partially define the second volume. A second valve plug may be coupled to the second diaphragm. A second valve seat may be formed in a second central aperture that is in fluid communication with the central passage. A second spring may be disposed within the second volume biasing the second valve plug into sealing engagement with the second valve seat such that the second poppet valve is normally closed. The third poppet valve may include a third diaphragm circumferentially secured to the first module, and the third diaphragm may at least partially define the third volume. A third valve plug may be coupled to the third diaphragm, and a third valve seat may be formed in a third central aperture that is in fluid communication with the second central passage. A third spring may be disposed within the third volume biasing the third valve plug into sealing engagement with the third valve seat such that the third poppet valve is normally closed. The fourth poppet valve may include a fourth diaphragm circumferentially secured to the first module, and the fourth diaphragm may at least partially define the fourth volume. A fourth valve plug may be coupled to the fourth diaphragm, and a fourth valve seat may be formed in a fourth central aperture that is in fluid communication with the second central passage. A fourth spring may be disposed within the fourth volume biasing the fourth valve plug into sealing engagement with the fourth valve seat such that the fourth poppet valve is normally closed.

In accordance with yet another exemplary aspect of the present invention, the first poppet valve may be closed when pressurized fluid from the supply enters the first volume of the first poppet valve and acts on the first diaphragm such that the first valve plug coupled to the first diaphragm is displaced towards the first valve seat. The first poppet valve may be opened when pressurized fluid within the first volume of the first poppet valve exits the first volume of the first poppet valve, and pressurized fluid from the first volume of the pneumatic actuator acts on the first valve plug and the first diaphragm, resulting in a force that overcomes the biasing force of the first spring, thereby displacing the first valve plug away from the first valve seat.

In accordance with still one more exemplary aspect of the present invention, the second poppet valve may be closed when pressurized fluid from the supply enters the second volume of the second poppet valve and acts on the second diaphragm such that the second valve plug coupled to the second diaphragm is displaced towards the second valve seat. The second poppet valve may be opened when pressurized fluid within the second volume of the second poppet valve exits the second volume of the second poppet valve, and pressurized fluid from the first volume of the pneumatic actuator acts on the second valve plug and the second diaphragm, resulting in a force that overcomes the biasing force of the second spring, thereby displacing the second valve plug away from the second valve seat.

In accordance with one more exemplary aspect of the present invention, the third poppet valve may be closed when pressurized fluid from the supply enters the third volume of the third poppet valve and acts on the third diaphragm such that the third valve plug coupled to the third diaphragm is displaced towards the third valve seat. The third poppet valve may be opened when pressurized fluid within the third volume of the third poppet valve exits the third volume of the first poppet valve, and pressurized fluid from the second volume of the pneumatic actuator acts on the third valve plug and the third diaphragm, resulting in a force that overcomes the biasing force of the third spring, thereby displacing the third valve plug away from the third valve seat.

In accordance with a further exemplary aspect of the present invention, the fourth poppet valve may be closed when pressurized fluid from the supply enters the fourth volume of the fourth poppet valve and acts on the fourth diaphragm such that the fourth valve plug coupled to the fourth diaphragm is displaced towards the fourth valve seat. The fourth poppet valve may be opened when pressurized fluid within the fourth volume of the fourth poppet valve exits the fourth volume of the fourth poppet valve, and pressurized fluid from the second volume of the pneumatic actuator acts on the fourth valve plug and the fourth diaphragm, resulting in a force that overcomes the biasing force of the fourth spring, thereby displacing the fourth valve plug away from the fourth valve seat.

In accordance with yet one more exemplary aspect of the present invention, when the work port of the first control valve is in fluid communication with the supply port of the first control valve, and the work port of the second control valve is in fluid communication with the supply port of the second control valve, pressurized fluid cannot be vented from the first volume and second volume of the pneumatic actuator, thereby preventing the actuator arm from being displaced in either the first direction or the second direction.

In accordance with yet another more exemplary aspect of the present invention, the pressurized fluid may be compressed air.

In accordance with one more exemplary aspect of the present invention, a system for controlling a pneumatic actuator may include a supply of pressurized fluid. A first module may be disposed within a valve housing, the first module including a first normally closed poppet valve and a second normally closed poppet valve, wherein each of the first and second poppet valves has an open position and a closed position. A first central port may be formed in the first module that is in fluid communication with a first volume of the pneumatic actuator. A first exhaust port may be formed in the first module, the first exhaust port being in fluid communication with the atmosphere such that the first central port, and the first volume of the pneumatic actuator in fluid communication with the first central port, is in fluid communication with the atmosphere when the first poppet valve is in the open position, and the first central port, and the first volume of the pneumatic actuator in fluid communication with the first central port, is not in fluid communication with the atmosphere when the first poppet valve is in the closed position. A first supply port may be formed in the first module, the first supply port being in fluid communication with the supply of pressurized fluid such that the first central port, and the first volume of the pneumatic actuator in fluid communication with the first central port, is in fluid communication with the supply of pressurized fluid when second poppet valve is in the open position, and the first central port, and the first volume of the pneumatic actuator in fluid communication with the first central port, is not in fluid communication with the supply of pressurized fluid when second poppet valve is in the closed position. A second module may be disposed within the valve housing adjacent to the first module, and the second module may include a third normally closed poppet valve and a fourth normally closed poppet valve, wherein each of the third and fourth poppet valves has an open position and a closed position. A second central port may be formed in the second module that is in fluid communication with a second volume of the pneumatic actuator. A second exhaust port may be formed in the second module, the second exhaust port being in fluid communication with the atmosphere such that the second central port, and the second volume of the pneumatic actuator in fluid communication with the second central port, is in fluid communication with the atmosphere when the third poppet valve is in the open position, and the second central port, and the second volume of the pneumatic actuator in fluid communication with the second central port, is not in fluid communication with the atmosphere when the third poppet valve is in the closed position. A supply port may be formed in the second module, the supply port being in fluid communication with the supply of pressurized fluid such that the second central port, and the second volume of the pneumatic actuator in fluid communication with the second central port, is in fluid communication with the supply of pressurized fluid when fourth poppet valve is in the open position, and the second central port, and the second volume of the pneumatic actuator in fluid communication with the second central port, is not in fluid communication with the supply of pressurized fluid when fourth poppet valve is in the closed position. A first control valve may have a supply port, a first work port, a second work port, a first exhaust port, and a second exhaust port, wherein the supply port of the first control valve is in fluid communication with the supply of pressurized fluid, the first work port of the first control valve is in fluid communication with the second poppet valve and third poppet valve, the second work port of the first control valve is in fluid communication with the first poppet valve and fourth poppet valve, and the first exhaust port and second exhaust port of the first control valve is in fluid communication with the atmosphere. The first volume of the pneumatic actuator may be partially defined by a first surface of a piston and an interior surface of an actuator body, and an actuator arm is secured to the piston such that when the supply of pressurized fluid is in fluid communication with the first volume of the pneumatic actuator, a force on the first surface of the piston caused by the pressurized fluid may displace the actuator arm in a first direction. The second volume of the pneumatic actuator may be partially defined by a second side of the piston and the interior surface of an actuator such that when the supply of pressurized fluid is in fluid communication with the second volume of the pneumatic actuator, a force on the second surface of the piston caused by the pressurized fluid displaces the actuator arm in a second direction opposite the first direction.

In accordance with yet one more exemplary aspect of the present invention, the first control valve may have a first position and a second position. In the first position, the first work port of the first control valve may be in fluid communication with the first exhaust port of the first control valve, and the second work port of the first control valve may be in fluid communication with the supply port of the first control valve. In the second position, the first work port of the first control valve may be in fluid communication with the supply port of the first control valve, and the second work port of the first control valve may be in fluid communication with the second exhaust port of the first control valve.

In accordance with yet another exemplary aspect of the present invention, the system may include a second control valve and a third control valve. The second control valve may move the first control valve from the first position to the second position, and the third control valve may move the first control valve from the second position to the first position.

In accordance with still one more exemplary aspect of the present invention, the first control valve may be a 5/2 shuttle valve, the second control valve may be a 3/2 pilot valve, and the third control valve may be a 3/2 pilot valve. Alternatively, the first control valve may be a 5/2 spool valve, the second control valve may be a 3/2 pilot valve, and the third control valve may be a 3/2 pilot valve.

In accordance with a further exemplary aspect of the present invention, when the first control valve is in the first position, the first poppet valve and the fourth poppet valve may be moved to the closed position by pressurized fluid from the supply, the second poppet valve may be opened by pressurized fluid from the first volume of the pneumatic actuator acting on a portion of the second poppet valve, and the third poppet valve may be opened by pressurized fluid from the second volume of the pneumatic actuator acting on a portion of the third poppet valve.

In accordance with another exemplary aspect of the present invention, when the first control valve is in the second position, the second poppet valve and the third poppet valve may be moved to the closed position by pressurized fluid from the supply, the first poppet valve may be opened by pressurized fluid from the first volume of the pneumatic actuator acting on a portion of the first poppet valve, and the fourth poppet valve may be opened by pressurized fluid from the fourth volume of the pneumatic actuator acting on a portion of the fourth poppet valve.

In accordance with a further exemplary aspect of the present invention, the first poppet valve may include a first volume, and a first poppet port may be formed in the first module such that the first poppet port is in fluid communication with the first volume. The second poppet valve may include a second volume, and a second poppet port may be formed in the first module such that the second poppet port is in fluid communication with the second volume. The third poppet valve may comprise a third volume, and a third poppet port may be formed in the first module such that the third poppet port is in fluid communication with the third volume. The fourth poppet valve may include a fourth volume, and a fourth poppet port may be formed in the first module such that the fourth poppet port is in fluid communication with the fourth volume.

In accordance with one more exemplary aspect of the present invention, the first poppet valve may include a first diaphragm circumferentially secured to the first module, and the first diaphragm may at least partially define the first volume. A first valve plug may be coupled to the first diaphragm, and a first valve seat may be formed in a first central aperture that is in fluid communication with the central passage. A first spring may be disposed within the first volume that biases the first valve plug into sealing engagement with the first valve seat such that the first poppet valve is normally closed. The second poppet valve may include a second diaphragm circumferentially secured to the first module, and the second diaphragm may at least partially define the second volume. A second valve plug may be coupled to the second diaphragm. A second valve seat may be formed in a second central aperture that is in fluid communication with the central passage. A second spring may be disposed within the second volume that biases the second valve plug into sealing engagement with the second valve seat such that the second poppet valve is normally closed. The third poppet valve may include a third diaphragm circumferentially secured to the first module, and the third diaphragm may at least partially define the third volume. A third valve plug may be coupled to the third diaphragm, and a third valve seat may be formed in a third central aperture that is in fluid communication with the second central passage. A third spring may be disposed within the third volume that biases the third valve plug into sealing engagement with the third valve seat such that the third poppet valve is normally closed. The fourth poppet valve may include a fourth diaphragm circumferentially secured to the first module, and the fourth diaphragm may at least partially define the fourth volume. A fourth valve plug may be coupled to the fourth diaphragm, and a fourth valve seat may be formed in a fourth central aperture that is in fluid communication with the second central passage. A fourth spring may be disposed within the fourth volume that biases the fourth valve plug into sealing engagement with the fourth valve seat such that the fourth poppet valve is normally closed.

In accordance with a further exemplary aspect of the present invention, the first poppet valve may be closed when pressurized fluid from the supply enters the first volume of the first poppet valve and acts on the first diaphragm such that the first valve plug coupled to the first diaphragm is displaced towards the first valve seat. The first poppet valve may be opened when pressurized fluid within the first volume of the first poppet valve exits the first volume of the first poppet valve, and pressurized fluid from the first volume of the pneumatic actuator acts on the first valve plug and the first diaphragm, resulting in a force that overcomes the biasing force of the first spring, thereby displacing the first valve plug away from the first valve seat.

In accordance with one more exemplary aspect of the present invention, the second poppet valve may be closed when pressurized fluid from the supply enters the second volume of the second poppet valve and acts on the second diaphragm such that the second valve plug coupled to the second diaphragm is displaced towards the second valve seat. The second poppet valve may be opened when pressurized fluid within the second volume of the second poppet valve exits the second volume of the second poppet valve, and pressurized fluid from the first volume of the pneumatic actuator acts on the second valve plug and the second diaphragm, resulting in a force that overcomes the biasing force of the second spring, thereby displacing the second valve plug away from the second valve seat.

In accordance with a still further exemplary aspect of the present invention, the third poppet valve may be closed when pressurized fluid from the supply enters the third volume of the third poppet valve and acts on the third diaphragm such that the third valve plug coupled to the third diaphragm is displaced towards the third valve seat. The third poppet valve may be opened when pressurized fluid within the third volume of the third poppet valve exits the third volume of the first poppet valve, and pressurized fluid from the second volume of the pneumatic actuator acts on the third valve plug and the third diaphragm, resulting in a force that overcomes the biasing force of the third spring, thereby displacing the third valve plug away from the third valve seat.

In accordance with yet one more exemplary aspect of the present invention, the fourth poppet valve may be closed when pressurized fluid from the supply enters the fourth volume of the fourth poppet valve and acts on the fourth diaphragm such that the fourth valve plug coupled to the fourth diaphragm is displaced towards the fourth valve seat. The fourth poppet valve may be opened when pressurized fluid within the fourth volume of the fourth poppet valve exits the fourth volume of the fourth poppet valve, and pressurized fluid from the second volume of the pneumatic actuator acts on the fourth valve plug and the fourth diaphragm, resulting in a force that overcomes the biasing force of the fourth spring, thereby displacing the fourth valve plug away from the fourth valve seat.

In accordance with still one more exemplary aspect of the present invention, a method of operating a pneumatic cylinder may include providing a supply of pressurized fluid and operatively coupling the supply to a first control valve and a second control valve, wherein the flow of the pressurized fluid may be controlled by the first control valve and the second control valve. A first module may be provided including a first normally closed poppet valve and a second normally closed poppet valve. The method may also include operatively coupling the second control valve to the first poppet valve of the first module, wherein the first poppet valve is opened and closed by pressurized fluid flowing through the second control valve. Additionally, the method may include operatively coupling the first control valve to the second poppet valve of the first module, wherein the second poppet valve is opened and closed by pressurized fluid flowing through the first control valve. The method may also include operatively coupling the supply to the second poppet valve of the first module such that when the second poppet valve is in an open position and the first poppet valve is in a closed position, pressurized fluid is provided to a first volume within a pneumatic cylinder, resulting in a translation of the pneumatic actuator in a first direction. The method may finally include operatively coupling the first poppet valve of the first module to an exhaust port such that when the first poppet valve is in the open position and the second poppet valve is in the closed position, pressurized fluid within the first volume of the pneumatic cylinder is exhausted allowing for a translation of the pneumatic actuator in a second direction opposite to the first direction.

In accordance with a further exemplary aspect of the present invention, each of the first and second control valves may have a first position and a second position. In the first position, pressurized fluid may flow from the supply, through the control valve, and into the first or second poppet valve, thereby closing the first or second poppet valve. Each may have a second position wherein pressurized fluid may flow from the first or second poppet valve, through the control valve, and may be vented to the atmosphere, thereby allowing the first or second poppet valve to be opened.

In accordance with one more exemplary aspect of the present invention, when the first control valve is in the second position, the second control valve is in the first position, and when the first control valve is in the first position, the second control valve is in the second position. In one more exemplary aspect of the present invention, the first control valve is a pilot valve and the second control valve is a shuttle valve. In accordance with a further exemplary aspect of the present invention, the pilot valve may move the shuttle valve from the first position to the second position. Alternatively, the pilot valve may move the shuttle valve from the second position to the first position. Also, the first control valve may be a shuttle valve and the second control valve may be a pilot valve. Also, the pilot valve may move the shuttle valve from the first position to the second position, or the pilot valve may move the shuttle valve from the second position to the first position.

In accordance with a further exemplary aspect of the present invention, the first poppet valve may include a first diaphragm circumferentially secured to the first module, and the first diaphragm may at least partially define a first volume. A first valve plug may be coupled to the first diaphragm, and a first valve seat may be formed in a first central aperture of the first module that is in fluid communication with the first volume within the pneumatic cylinder. A first spring may be disposed within the first volume that biases the first valve plug into sealing engagement with the first valve seat such that the first poppet valve is normally closed. The second poppet valve may include a second diaphragm circumferentially secured to the first module, and the second diaphragm may at least partially define a second volume. A second valve plug may be coupled to the second diaphragm. A second valve seat may be formed in a second central aperture of the first module that is in fluid communication with the first volume within the pneumatic cylinder. A second spring may be disposed within the second volume that biases the second valve plug into sealing engagement with the second valve seat such that the second poppet valve is normally closed.

In accordance with a still further exemplary aspect of the present invention, the first poppet valve may be maintained in the closed position by pressurized fluid within the first volume, and the second poppet valve may be maintained in the closed position by pressurized fluid within the second volume.

In accordance with yet one more exemplary aspect of the present invention, the method may include providing a second module including a third normally closed poppet valve and a fourth normally closed poppet valve and operatively coupling the first control valve to the third poppet valve of the second module, wherein the third poppet valve is opened and closed by pressurized fluid flowing through the first control valve. The method may also include operatively coupling the second control valve to the fourth poppet valve of the second module, wherein the fourth poppet valve is opened and closed by pressurized fluid flowing through the second control valve. Additionally, the method may also include operatively coupling the supply to the fourth poppet valve of the second module such that when the fourth poppet valve is in an open position and the third poppet valve is in a closed position, pressurized fluid is provided to a second volume within the pneumatic cylinder, resulting in a translation of the pneumatic actuator in the second direction. Finally, the method may also include operatively coupling the third poppet valve of the second module to an exhaust port such that when the third poppet valve is in the open position and the fourth poppet valve is in the closed position, pressurized fluid within the second volume of the pneumatic cylinder is exhausted allowing for a translation of the pneumatic actuator in the first direction.

In accordance with another exemplary aspect of the present invention, the first control valve may have a first position and a second position. In the first position, pressurized fluid may flow from the supply, through the first control valve, and into the second and third poppet valves, thereby closing the second and third poppet valves. In the second position, pressurized fluid may flow from the second and third poppet valves, through the first control valve, and may be vented to the atmosphere, thereby allowing the second and third poppet valves to be opened.

In accordance with a further exemplary aspect of the present invention, the second control valve may have a first position and a second position, wherein in the first position, pressurized fluid flows from the supply, through the second control valve, and into the first and fourth poppet valves, thereby closing the first and fourth poppet valves. In the second position, pressurized fluid may flow from the first and fourth poppet valves, through the second control valve, and may be vented to the atmosphere, thereby allowing the first and fourth poppet valves to be opened.

In accordance with yet another exemplary aspect of the present invention, the first control valve may be a pilot valve and the second control valve may be a shuttle valve, and the pilot valve may move the shuttle valve from the first position to the second position. In accordance with a further exemplary aspect of the present invention, the first control valve may be a pilot valve and the second control valve may be a shuttle valve, and the pilot valve may move the shuttle valve from the second position to the first position. Alternatively, the first control valve may be a shuttle valve and the second control valve may be a pilot valve, and the pilot valve may move the shuttle valve from the first position to the second position. Additionally, the first control valve may be a shuttle valve and the second control valve may be a pilot valve, and the pilot valve may move the shuttle valve from the second position to the first position. Also, the first control valve may be a first pilot valve and the second control valve may be a second pilot valve.

In accordance with a further exemplary aspect of the present invention, when the first pilot valve and the second pilot valve are in the first position, the first poppet valve, the second poppet valve, the third poppet valve, and the fourth poppet valve may be maintained in the closed position such that volume of the pressurized fluid in the first and second volume within the pneumatic cylinder remains constant, thereby preventing the pneumatic cylinder from translating in either the first direction or the second direction.

In accordance with a still further exemplary aspect of the present invention, the third poppet valve may include a third diaphragm circumferentially secured to the first module, and the third diaphragm may at least partially define a third volume. A third valve plug may be coupled to the third diaphragm, and a third valve seat may be formed in a third central aperture of the second module that is in fluid communication with the second volume within the pneumatic cylinder. A third spring may be disposed within the third volume that biases the third valve plug into sealing engagement with the third valve seat such that the third poppet valve is normally closed. The fourth poppet valve may include a fourth diaphragm circumferentially secured to the first module, and the fourth diaphragm may at least partially define a fourth volume. A fourth valve plug may be coupled to the fourth diaphragm, and a fourth valve seat may be formed in a fourth central aperture in the second module that is in fluid communication with the second volume within the pneumatic cylinder. A fourth spring may be disposed within the fourth volume that biases the fourth valve plug into sealing engagement with the fourth valve seat such that the fourth poppet valve is normally closed.

In accordance with another exemplary aspect of the present invention, the third poppet valve may be maintained in the closed position by pressurized fluid within the third volume, and the fourth poppet valve may be maintained in the closed position by pressurized fluid within the fourth volume.

In accordance with yet another exemplary aspect of the present invention, a method of operating a pneumatic cylinder includes providing a supply of pressurized fluid. The method may further include providing a first control valve, and the first control valve may include a first supply port, a second supply port, a first exhaust port in fluid communication with the atmosphere, a second exhaust port in fluid communication with the atmosphere, and a supply port that is operatively coupled to the supply. The method may also include providing a first module having a first normally closed poppet valve and a second normally closed poppet valve. The method may further include providing a second module comprising a third normally closed poppet valve and a fourth normally closed poppet valve. The first work port of the first control valve may be operatively coupled to both the second poppet valve of the first module and the third poppet valve of the second module, wherein the second and third poppet valves are opened and closed by pressurized fluid flowing through the first work port. Additionally, the second work port of the first control valve may be operatively coupled to the first poppet valve of the first module and the fourth poppet valve of the second module, wherein the first and fourth poppet valves are opened and closed by pressurized fluid flowing through the second work port. The supply may be operatively coupled to the second poppet valve of the first module such that when the second poppet valve is in an open position and the first poppet valve is in a closed position, pressurized fluid is provided to a first volume within a pneumatic actuator, resulting in a translation of the pneumatic actuator in a first direction. Finally, the supply may be operatively coupled to the fourth poppet valve of the second module such that when the fourth poppet valve is in an open position and the third poppet valve is in a closed position, pressurized fluid is provided to a second volume within the pneumatic actuator, resulting in a translation of the pneumatic actuator in a second direction that is opposite the first direction.

In accordance with one more exemplary aspect of the present invention, the first poppet valve of the first module may be operatively coupled to an exhaust port such that when the second poppet valve is closed and the first poppet valve is open, pressurized fluid from the first volume of the pneumatic actuator can vent through the exhaust port. The third poppet valve of the second module may be operatively coupled to an exhaust port such that when the fourth poppet valve is closed and the third poppet valve is open, pressurized fluid from the second volume of the pneumatic actuator can vent through the exhaust port.

In accordance with another exemplary aspect of the present invention, the first control valve may have a first position and a second position. In the first position, the first work port may be in communication with the first exhaust port and the second work port may be in fluid communication with the supply port. In the second position, the first work port may be in communication with the supply port and the second work port may be in fluid communication with the second exhaust port.

In accordance with a further exemplary aspect of the present invention, a second control valve and a third control valve may be provided, wherein each of the second and third control valves has a work port, an exhaust port operatively coupled to the atmosphere, and a supply port operatively coupled to the supply. The work port of each of the second and third control valves may be operatively coupled to the first control valve such that the second control valve moves the first control valve from the first position to the second position, and the third control valve moves the first control valve from the second position to the first position.

In accordance with another exemplary aspect of the present invention, the first control valve is a spool valve and the second and third control valves are pilot valves.

In accordance with still one more exemplary aspect of the present invention, the first poppet valve may include a first diaphragm circumferentially secured to the first module, and the first diaphragm may at least partially define a first volume. A first valve plug may be coupled to the first diaphragm. A first valve seat may be formed in a first central aperture of the first module that is in fluid communication with the first volume within the pneumatic cylinder. A first spring may be disposed within the first volume biases the first valve plug into sealing engagement with the first valve seat such that the first poppet valve is normally closed. The second poppet valve may include a second diaphragm circumferentially secured to the first module, and the second diaphragm may at least partially define a second volume. A second valve plug may be coupled to the second diaphragm. A second valve seat may be formed in a second central aperture of the first module that is in fluid communication with the first volume within the pneumatic cylinder. A second spring may be disposed within the second volume biases the second valve plug into sealing engagement with the second valve seat such that the second poppet valve is normally closed. The third poppet valve may include a third diaphragm circumferentially secured to the second module, and the third diaphragm may at least partially define a third volume. A third valve plug may be coupled to the third diaphragm. A third valve seat may be formed in a third central aperture of the second module that is in fluid communication with the second volume within the pneumatic cylinder. A third spring may be disposed within the third volume biases the third valve plug into sealing engagement with the third valve seat such that the third poppet valve is normally closed. The fourth poppet valve may include a fourth diaphragm circumferentially secured to the second module, and the fourth diaphragm may at least partially define a fourth volume. A fourth valve plug may be coupled to the fourth diaphragm. A fourth valve seat may be formed in a fourth central aperture of the second module that is in fluid communication with the second volume within the pneumatic cylinder. A fourth spring may be disposed within the fourth volume biases the fourth valve plug into sealing engagement with the fourth valve seat such that the fourth poppet valve is normally closed.

In accordance with yet another exemplary aspect of the present invention, the first poppet valve may be maintained in the closed position by pressurized fluid within the first volume, the second poppet valve may be maintained in the closed position by pressurized fluid within the second volume, the third poppet valve may be maintained in the closed position by pressurized fluid within the third volume, and the fourth poppet valve may be maintained in the closed position by pressurized fluid within the fourth volume.

DETAILED DESCRIPTION OF THE INVENTION

Figure 1:
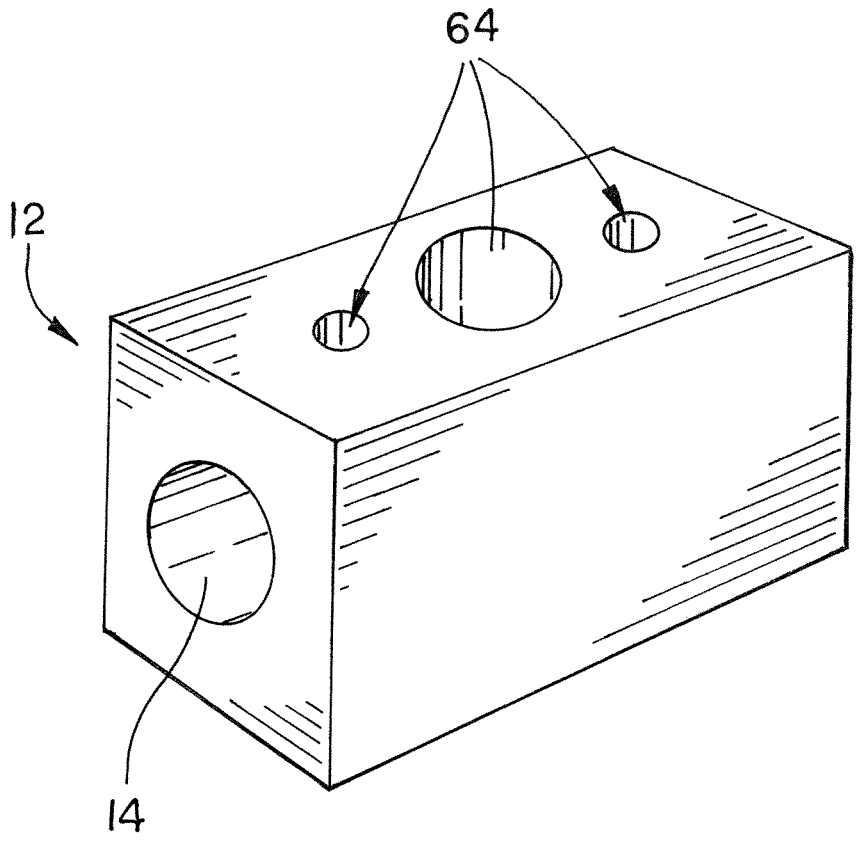
FIG. 1 is a perspective view of the housing of an embodiment of the of the poppet valve assembly.
Figure 2A:
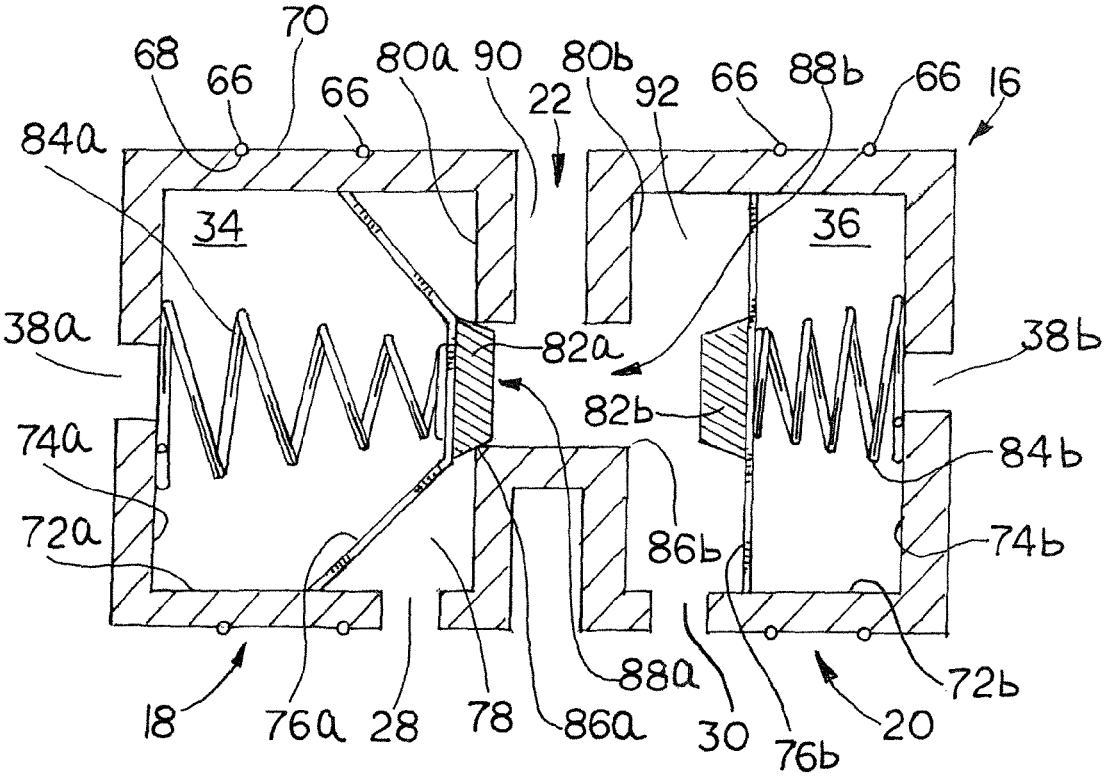
FIG. 2A is a sectional view of the first module of an embodiment of the poppet valve assembly.
Figure 2B:
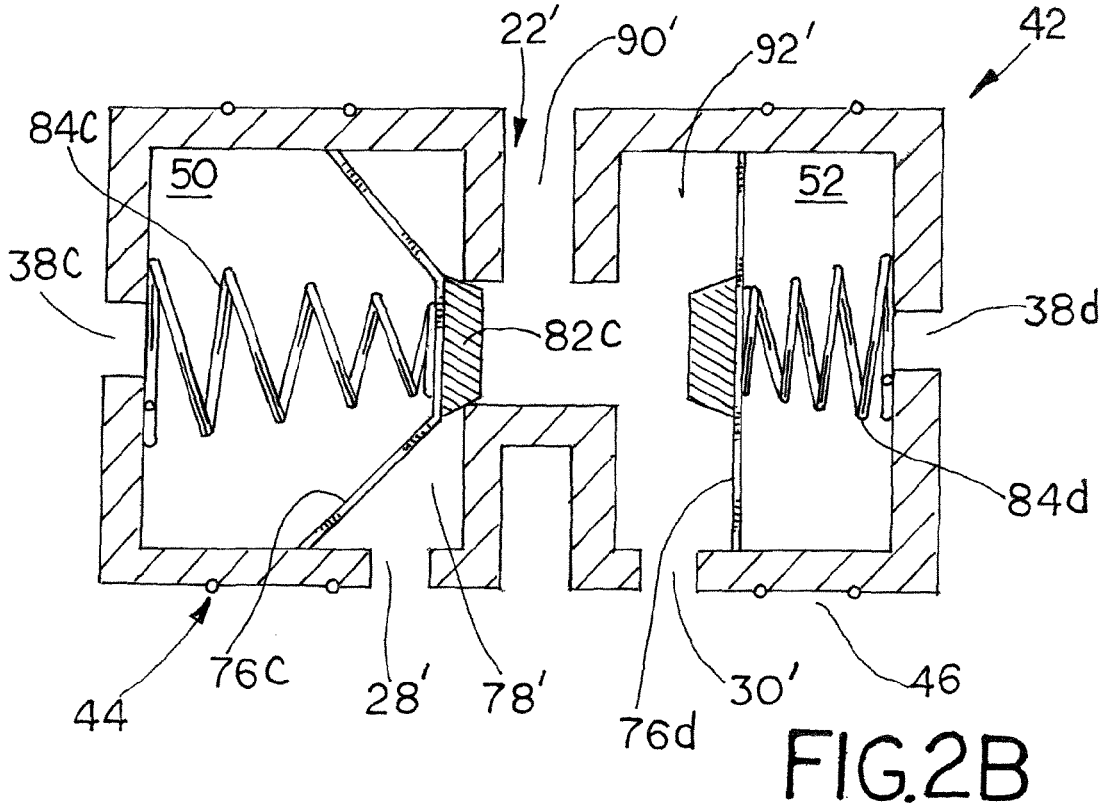
FIG. 2B is a sectional view of the second module of an embodiment of the poppet valve assembly.
Figure 3A:
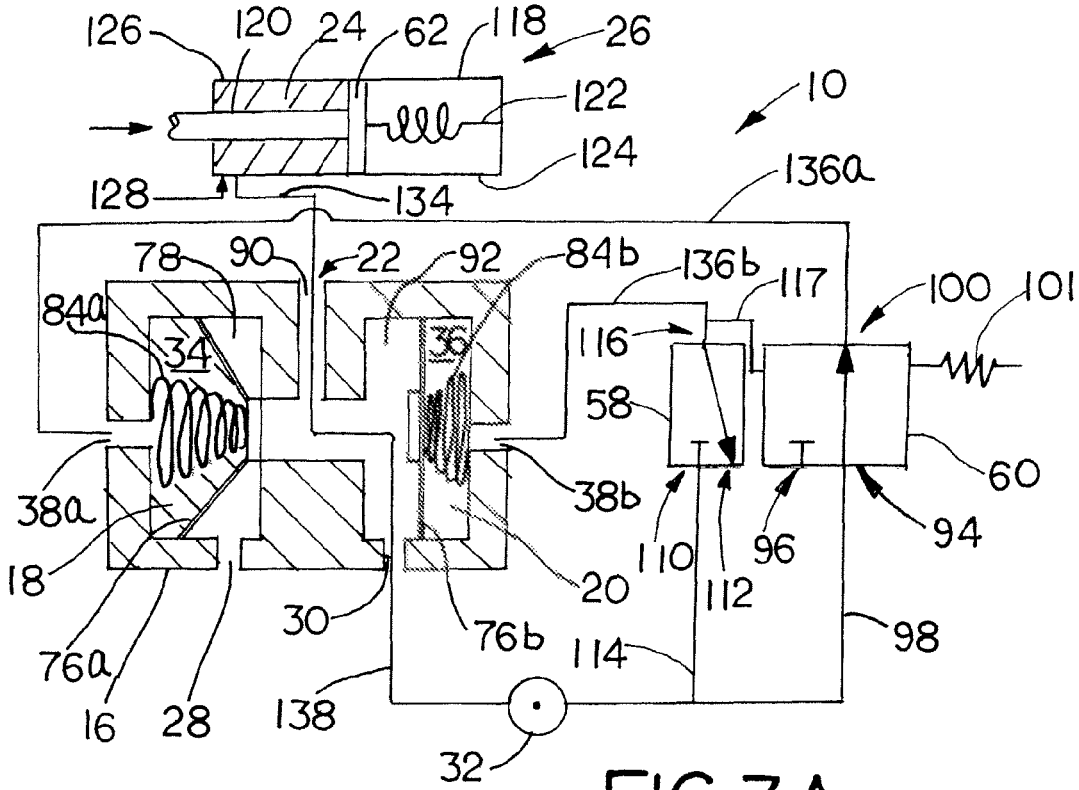
FIG. 3A is a schematic view of an embodiment of the poppet valve assembly having 3/2 functionality wherein the first poppet valve is in the closed position and the second poppet valve is in the open position such that the actuator arm of the pneumatic actuator is retracted into the body of the pneumatic actuator.
Figure 3B:
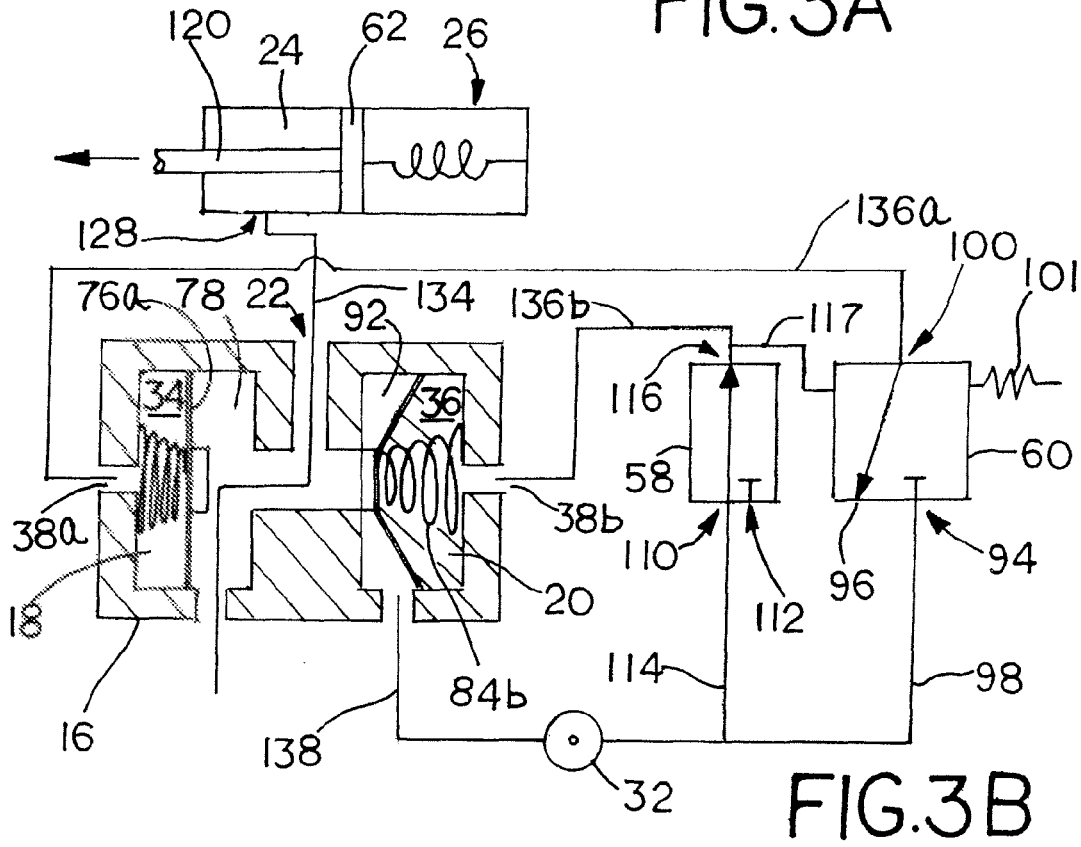
FIG. 3B is a schematic view of an embodiment of the poppet valve assembly having 3/2 functionality wherein the first poppet valve is in the open position and the second poppet valve is in the closed position such that the actuator arm of the pneumatic actuator extends from the body of the pneumatic actuator.

As illustrated in FIGS. 1, 2A and 2B, a poppet valve assembly 10 for the control of a pneumatic actuator may include a valve housing 12 having a central bore 14. A first module 16 may be disposed within the central bore 14, and the first module 16 may include a first normally closed poppet valve 18 and a second normally closed poppet valve 20. Each of the first and second normally closed poppet valves 18, 20 may have an open position and a closed position. A central port 22 may be formed in the first module 16, and the central port 22 of the first module 16 may be adapted to be coupled to a first volume 24 of a pneumatic actuator 26, as shown in FIGS. 3A and 3B. An exhaust port 28 may be formed in the first module 16 such that the central port 22 is in fluid communication with the exhaust port 28 when the first poppet valve 18 is in the open position. A supply port 30 may be formed in the first module 16 such that the central port 22 is in fluid communication with the supply port 30 when the second normally closed poppet valve 20 is in the open position. The supply port 30 may be configured to be in fluid communication with a supply 32 of pressurized fluid such that when the second normally closed poppet valve 20 is in the open position, pressurized fluid is provided to the first volume 24 of the pneumatic actuator 26, as illustrated in FIGS. 3A and 3B. The exhaust port 28 may be configured to vent pressurized fluid from the first volume 24 of the pneumatic actuator 26 when the first normally closed poppet valve 18 is in the open position. The first normally closed poppet valve 18 may include a first volume 34 and the second normally closed poppet valve 20 may include a second volume 36. A first poppet port 38*a* may be formed in the first module 16, and the first poppet port 38*a* may be in fluid communication with the first volume 34 and adapted to be both an inlet and an outlet for a pressurized fluid. A second poppet port 38*b* may be formed in the first module 16, the second poppet port 38*b* may be in fluid communication with the second volume 36 and adapted to be both an inlet and an outlet for a pressurized fluid.

Figure 4A:
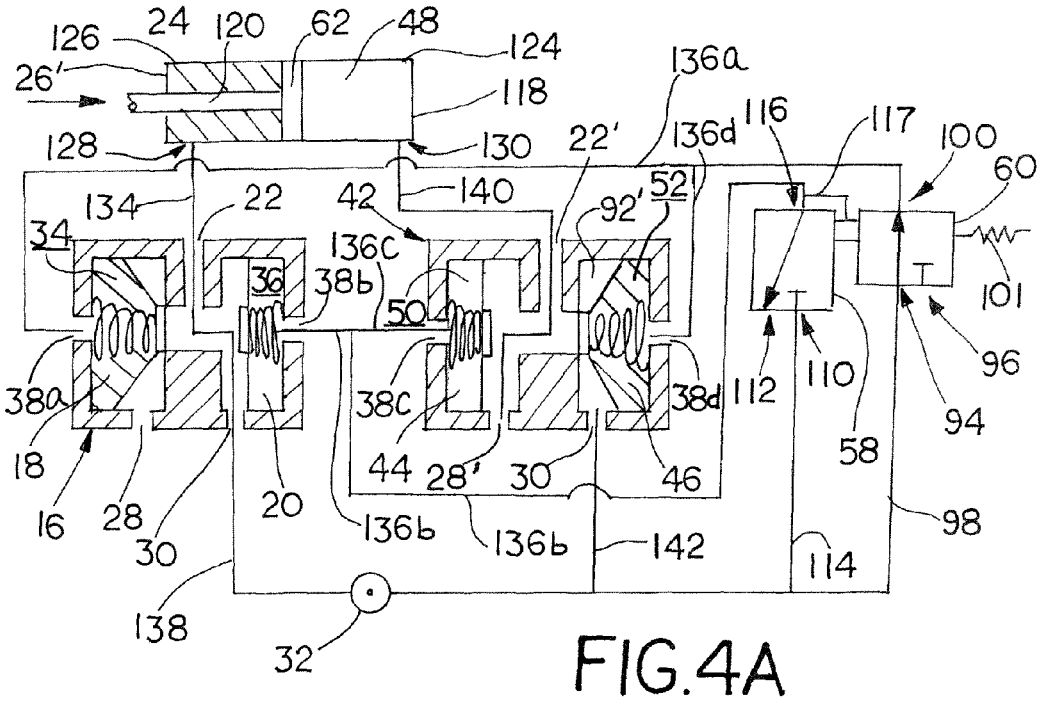
FIG. 4A is a schematic view of an embodiment of the poppet valve assembly having 5/2 functionality wherein the first poppet valve of the first module and the fourth poppet valve of the second module are in the closed position and the second poppet valve of the first module and the third poppet valve of the second module are in the open position such that the actuator arm of the pneumatic actuator is retracted into the body of the pneumatic actuator.
Figure 4B:
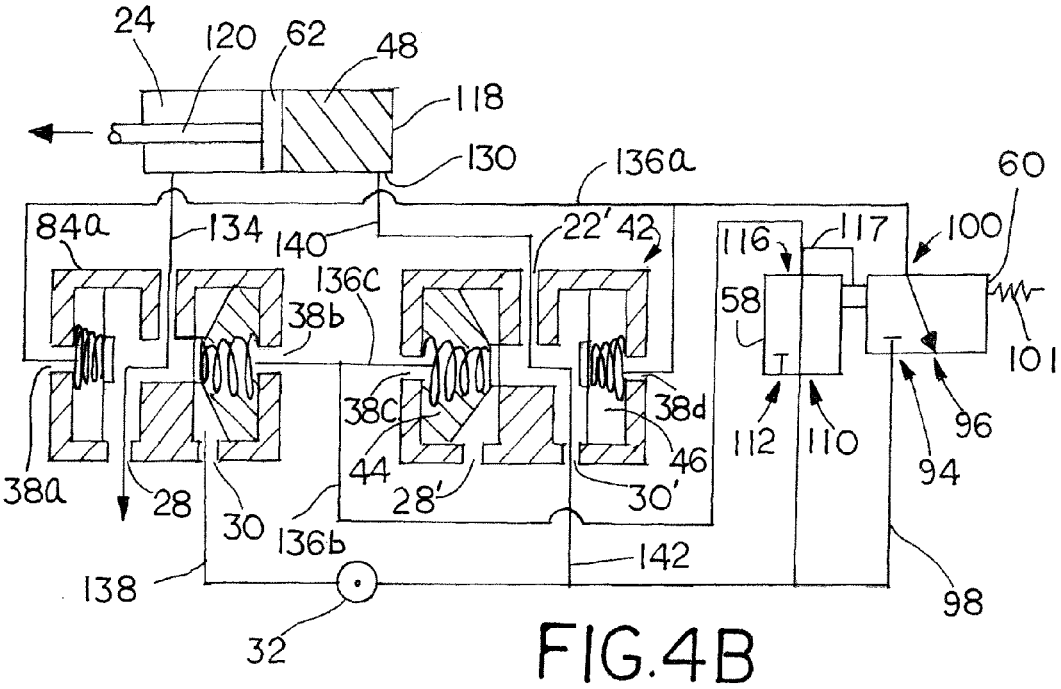
FIG. 4B is a schematic view of an embodiment of the poppet valve assembly having 5/2 functionality wherein the first poppet valve of the first module and the fourth poppet valve of the second module are in the open position and the second poppet valve of the first module and the third poppet valve of the second module are in the closed position such that the actuator arm of the pneumatic actuator extends from the body of the pneumatic actuator.

A second module 42, illustrated in FIGS. 2B, 4A and 4B, may be disposed adjacent to the first module 16 within the central bore 14 of the housing 12, the second module 42 including a third normally closed poppet valve 44 and a fourth normally closed poppet valve 46. The second module 42 may be substantially identical in geometry and function to the first module 16, with the third normally closed poppet valve 44 corresponding to the first normally closed poppet valve 48 and the fourth normally closed poppet valve 44 corresponding to the second normally closed poppet valve 18. A supply port 30' of the second module 42 may be configured to be in fluid communication with the supply 32 of pressurized fluid such that when the fourth normally closed poppet valve 46 is in the open position, pressurized fluid is provided to a second volume 48 of the pneumatic actuator 26, as shown in FIGS. 4A and 4B. An exhaust port 28' of the second module 42 may be configured to vent pressurized fluid from the third volume 50 of the pneumatic actuator 26 when the third normally closed poppet valve 44 is in the open position. The third normally closed poppet valve 44 may include a third volume 50 and the fourth normally closed poppet valve 46 may include a fourth volume 52. A third poppet port 38*c* may be formed in the second module 42, and the third poppet port 38*c* may be in fluid communication with the third volume 50 and adapted to be both an inlet and an outlet for a pressurized fluid. A fourth poppet port 38*d* may be formed in the second module 42, and the fourth poppet port 38*d* may be in fluid communication with the fourth volume 52 and adapted to be both an inlet and an outlet for a pressurized fluid. The first, second, third, and fourth poppet ports 38*a*, 38*b*, 38*c*, 38*d* of both the first and second modules 16, 42 may be operatively connected to one or more control valves, such as a pilot valve 58 and/or a shuttle valve 60, and the control valves may control the position of a piston 62 of the pneumatic actuator 26.

As shown in FIG. 1 and as described above, the poppet valve assembly 10 may include a housing 12, and the housing 12 may be rectangular in cross-sectional shape. However, one having ordinary skill in the art would recognize that the shape of the housing 12 is not intended to be limiting, and the housing 12 may have any shape, or combination of shapes, appropriate for a specific application. The housing 12 may include a central bore 14 extending along a longitudinal axis of the housing 12. The central bore 14 may be cylindrical in shape, or may have any shape, such as that of an oval or a polygon. A plurality of ports 64 may be formed in the housing 12, and these ports 64 may be in fluid communication with the central bore 14. One having ordinary skill in the art would recognize that the location, number, and size of the plurality of ports 64 may vary based on the design parameters of a specific application. In fact, the poppet valve assembly 10 itself is comprised of interchangeable elements that can be custom-assembled for specific applications. For example, the housing 12 may also be configured to be used as a housing for a spool valve (not shown), reducing the overall number of application-specific parts in the assembly, thereby reducing manufacturing costs.

As illustrated in FIG. 2A, the poppet valve assembly 10 may also include a first module 16. The first module 16 may be cylindrical in shape and dimensioned to be inserted into the central bore 14 of the housing 12. However, the first module 16 may have any shape that allows it to be received into the central bore 14. A plurality of seals 66, such as o-rings, may be disposed in circumferential grooves 68 formed in an outside surface 70 of the first module 16 to seal the first module 16 within the central bore 14 when the first module 16 is inserted in the housing 12. As explained above, the first module 16 may include a first poppet valve 18 and a second poppet valve 20, and both the first and second poppet valves 18, 20 may be located at opposite longitudinal ends of the first module 16. The first poppet valve 18 may include a generally cylindrical first inner wall 72*a* and a generally planar first end wall 74*a*. A first diaphragm 76*a* may be circumferentially secured to the first inner wall 72*a* by any means known in the art such that a first volume 34 is defined by the first diaphragm 76*a*, a portion of the first inner wall 72*a*, and the first end wall 74*a*. A first poppet port 38*a* may be formed on the first end wall 74*a* such that the first poppet port 38*a* and the first volume 34 are in fluid communication. However, one having ordinary skill in the art would recognize that the first poppet port 38*a* may be disposed at any position on any surface defining the first volume 34 that allows the first poppet port 38*a* to be in fluid communication with the first volume 34. A first module exhaust port 28 may be formed on the first inner wall 72*a* outside of the first volume 34 such that the first module exhaust port 28 is in fluid communication with a first module exhaust volume 78. The first module exhaust volume 78 may be partially defined by the first diaphragm 76*a*, a portion of the first inner wall 72*a*, and a first central wall 56*a*. However, one having ordinary skill in the art would recognize that the first module exhaust port 28 could be disposed at any position on any surface defining the first module exhaust volume 78 that allows the first module exhaust port 28 to be in fluid communication with the first module exhaust volume 78.

Referring again to FIG. 2A, the first module 16 may also include a first valve plug 82*a* that may be secured to a central portion of the first diaphragm 76*a*. The first valve plug 82*a* may have a generally frustoconical shape, or may have the general shape of a disk. A first spring 84*a*, such as a coil spring, a wave spring, or any other suitable compression-type spring, may be disposed within the first volume 34 between the first diaphragm 76*a* and the first end wall 74*a*. The first spring 84*a* may bias the first valve plug 82*a* secured to the first diaphragm 76*a* towards a first valve seat 86*a* such that the first valve plug 82*a* sealingly engages the first valve seat 86*a*, closing the first poppet valve 18. The first valve seat 86*a* may be at least partially defined by a first central aperture 88*a* formed in a first module central passage 90 that is itself partially defined by a first module central port 22 formed on the outside surface 70 of the first module 16. When the first poppet valve 18 is in the closed position (i.e., when the first valve plug 82*a* sealingly engages the first valve seat 86*a*), the first module central port 22 is not in fluid communication with the first module exhaust volume 78. However, when the first poppet valve 18 is in the open position (i.e., when the first valve plug 82*a* does not sealingly engage the first valve seat 86*a*), the first module central port 22 is in fluid communication with the first module exhaust volume 78.

Still referring to FIG. 2A, the first module 16 of the poppet valve assembly 10 may also include a second poppet valve 20. One having ordinary skill in the art would recognize that the second poppet valve 20 may be physically and functionally identical to the first poppet valve 18. Accordingly, elements of the second poppet valve 20 that correspond to elements of the first poppet valve 18 have been given reference numbers similar to their first poppet valve 18 equivalents, and the description of these elements will not be repeated. For example, the second diaphragm 76*b* of the second poppet valve 20 may be physically and functionally identical to the first diaphragm 76*a* of the first poppet valve 18. There is, however, one important distinction between the first poppet valve 18 and the second poppet valve 20. Specifically, the second poppet valve 20 includes a first module supply port 30 that is in fluid communication with a first module supply volume 92. The first module supply volume 92 is the second poppet valve's 20 equivalent to the first module exhaust volume 78 of the first poppet valve 18. Accordingly, when the second poppet valve 20 is in the closed position (i.e., when the second valve plug 82*b* sealingly engages the second valve seat 86*b*), the first module central port 22 is not in fluid communication with the first module supply volume 92. However, when the second poppet valve 20 is in the open position (i.e., when the second valve plug 82*b* does not sealingly engage the second valve seat 86*b*), the first module central port 22 is in fluid communication with the first module supply volume 92.

As illustrated in FIG. 2B, and as previously explained, the poppet valve assembly 10 may also include a second module 42. The second module 42 may be physically and functionally identical to the first module 16, thereby reducing the cost of manufacturing the poppet valve assembly 10. Accordingly, the second module 42 may include a third poppet valve 44 that is identical to the first poppet valve 18 and a fourth poppet valve 46 that is identical to the second poppet valve 20. Elements of the third poppet valve 44 that correspond to equivalents elements of the first poppet valve 18 have been given reference numbers that correspond to their first poppet valve 18 equivalents, and the description of these elements will not be repeated. For example, the third diaphragm 76*c* of the third poppet valve 44 may be physically and functionally identical to the first diaphragm 76*a* of the first poppet valve 18. Additionally, elements of the first module 16 that correspond to equivalents elements of the second module 42 have been given reference numbers that correspond to their first module 16 equivalents. For example: the second module central port 22' of the second module 42 is identical to the first module central port 22 of the first module 16; the second module exhaust port 28' of the second module 42 is identical to the first module exhaust port 28 of the first module 16; and the second module supply port 30' of the second module 42 is identical to the first module supply port 30 of the first module 16.

As illustrated in FIGS. 3A and 3B, the poppet valve assembly 10 may also include a control valve, such as a shuttle valve 60. The shuttle valve 60 may include a shuttle supply port 94 and a shuttle exhaust port 96. The shuttle supply port 94 may be connected to a supply 32 of pressurized fluid, such as pressurized air, by a shuttle supply pneumatic line 98. The shuttle exhaust port 96 may be in fluid communication with the ambient environment such that the shuttle exhaust port can vent to the atmosphere. The shuttle valve 60 may also include a shuttle work port 100 that may be connected to one or more of the poppet ports 38*a*-38*d* in a manner that will be described in greater detail below. The shuttle may either have 3/2 or 5/2 functionality. To achieve 3/2 functionality, an internal shuttle (not shown) may alternate between a first shuttle position and a second shuttle position in a manner that is well-known in the art. The internal shuttle (not shown) may be biased in either the first shuttle position or the second shuttle position by a shuttle spring (not shown). The internal shuttle (not shown) may be moved from the first shuttle position to the second shuttle position, or vice versa, by a pilot valve 58, which will be described in greater detail below. In the first shuttle position, illustrated in FIG. 3A, the shuttle work port 100 may be in fluid communication with the shuttle supply port 94. In the second shuttle position, illustrated in FIG. 3B, the shuttle work port 100 may be in fluid communication with the shuttle exhaust port 96. Some applications may require 5/2 functionality in the shuttle, such as the 5/2 "fail last" function illustrated in FIGS. 5A and 5B. In these applications, the 5/2 shuttle 60' may have both a first shuttle work port 102 and a second shuttle work port 104. The 5/2 shuttle 60' may also have a shuttle supply port 94', a first shuttle exhaust port 106, and a second shuttle supply port 108. The shuttle supply port 94' may be connected to the supply 32 of pressurized fluid by the shuttle supply pneumatic line 98. The internal shuttle (not shown) may be moved from the first shuttle position to the second shuttle position, or vice versa, by one or more pilot valves 58. In the first shuttle position, illustrated in FIG. 5A, the second shuttle work port 104 may be in fluid communication with the shuttle supply port 94', and the first shuttle work port 102 may be in fluid communication with the first shuttle exhaust port 106. In the second shuttle position, illustrated in FIG. 5B, the second shuttle work port 104 may be in fluid communication with the second shuttle exhaust port 108, and the first shuttle work port 102 may be in fluid communication with the shuttle supply port 94'.

As illustrated in FIGS. 3A and 3B, the poppet valve assembly 10 may also include a second type of control valve, such as a pilot valve 58. The pilot valve 58 may include a pilot supply port 110 and a pilot exhaust port 112. The pilot supply port 110 may be connected to the supply 32 of pressurized fluid, such as pressurized air, by a pilot supply pneumatic line 114. The pilot exhaust port 112 may be in fluid communication with the ambient environment such that the pilot exhaust port 112 can vent to the atmosphere. The pilot valve 58 may also include a pilot work port 116 that may be connected to one or more of the poppet ports 38*a*-38*d* in a manner that will be described below. The pilot valve 58 may have 3/2 functionality, and operate in a manner similar to that of the shuttle valve 60. Specifically, an internal shuttle (not shown) may alternate between a first pilot position and a second pilot position. The internal shuttle (not shown) may be biased in either the first pilot position or the second pilot position by a shuttle spring (not shown). In the first pilot position, illustrated in FIG. 3A, the pilot work port 116 may be in fluid communication with the pilot exhaust port 112. In the second pilot position, illustrated in FIG. 3B, the pilot work port 100 may be in fluid communication with the pilot supply port 110. The pilot valve 58 may move from the first pilot position to the second pilot position, and vice versa, upon receiving an electrical input signal from a controller (not shown). Upon receiving the input signal, the pilot 58 may become energized (or, alternately, de-energized), and may mechanically move the internal shuttle (not shown) in a manner that is well known in the art. As previously mentioned, the pilot valve 58 may be coupled to the shuttle valve 64 to move the internal shuttle (not shown) of the shuttle valve 60 from the first shuttle position to the second shuttle position, or vice versa. Specifically, a pilot/shuttle pneumatic line 117 may connect the pilot 58 to the shuttle 60 such that when the pilot work port 116 is in fluid communication with the pilot supply port 110, pressure from the pilot valve 58 may act upon a surface of the internal shuttle (not shown) of the shuttle valve 60 by way of the pilot/shuttle pneumatic line 117 to move the internal shuttle from the first shuttle position to the second shuttle position, or vice versa.

As illustrated in FIG. 3A, the poppet valve assembly 10 may also include a pneumatic actuator 26. The pneumatic actuator 26 may include a cylindrical body 118 having a piston 62 slidably disposed within the body 118. An actuator arm 120 may be secured to the piston 62 such that the actuator arm 120 is longitudinally displaced as the piston 62 is displaced. In a first embodiment of the pneumatic actuator 26, an actuator spring 122 is disposed within the body 118 between a second end 124 of the body 118 and the piston 62, biasing the piston towards a first end 126 of the body 118. A first cylinder volume 24 is defined between the piston 62 and the first end 126 of the body 118. A first cylinder port 128 is disposed on the outer surface of the body 118 proximate to the first end 126 such that the first cylinder port 128 is in fluid communication with the first cylinder volume 24. Alternatively, in a second embodiment of the pneumatic actuator 26' illustrated in FIGS. 4A and 4B, the actuator spring 122 may be removed, and a second cylinder port 130 may be disposed on the outer surface of the body 118 proximate to the second end 124 such that the second cylinder port 130 is in fluid communication with a second cylinder volume 48 defined between the piston 62 and the second end 124 of the body 118.

As previously explained, the components described above are intended to be modular, and may be interchanged as required for a specific application. Accordingly, the operation of the poppet valve assembly 10 will now be described for several, but not all, of the possible applications.

When it is desired to achieve 3/2 functionality in the poppet valve assembly 10, as shown in FIGS. 3A and 3B, a single module, the first module 16, is disposed within the central bore 14 of the housing 12. For clarity, the housing 12 has been omitted from FIGS. 3A and 3B. A plurality of disk-like spacers (not shown) may be placed within the central bore 14 on either side of the first module 16 to center and support the first module 16 within the central bore 14. The first cylinder port 128 of the pneumatic actuator 26 may connected to the first module central port 22 by a first actuator pneumatic line 134 such that the first module central passage 90 is in fluid communication with the first cylinder volume 24 of the pneumatic actuator 26. The first poppet port 38*a* of the first module 16 may be connected to the shuttle work port 100 of the shuttle valve 60 by a first poppet pneumatic line 136*a*. Additionally, the second poppet port 38*b* of the first module 16 may be connected to the pilot work port 116 of the pilot valve 58 by a second poppet pneumatic line 136*b*. The first module supply port 30 of the first module 16 may be connected to the supply 32 by a module supply pneumatic line 138 such that the supply 32 is in fluid communication with the first module supply volume 92. As previously explained, the shuttle supply port 94 may be connected to the supply 32 by a shuttle supply pneumatic line 98, and a pilot supply pneumatic line 114 may connect the pilot supply port 110 to the supply 32. One having ordinary skill in the art would recognize that any of the pneumatic lines 134, 136*a*, 136*b*, 138 previously (or subsequently) described may extend through any of the plurality of ports 64 or through the central bore 14 formed in the housing 12 in a manner that would be well-known to one having ordinary skill in the art.

When the pilot valve 58 is in the first position (the de-energized state), as shown in FIG. 3A, the pilot work port 116 is in fluid communication with the pilot exhaust port 112, and no pressure is provided by the pilot 58 to move the shuttle 60 from the first position. In this first position, the first poppet port 38*a* is in fluid communication with the shuttle work port 100 and the shuttle work port 100 is in fluid communication with the shuttle supply port 94. Consequently, pressurized fluid from the supply 32 is fed into the first volume 34 of the first poppet valve 18, maintaining the first poppet valve 18 in the closed position. Also in this first position, the second poppet port 38*b* is in fluid communication with the pilot exhaust port 112. Consequently, any pressure within the second volume 36 of the second poppet valve 20 can vent to the atmosphere. The pressure in the first module supply volume 92 acts on the second diaphragm 76*b*, resulting in a force on the second diaphragm 76*b* that is greater than the opposing force provided by the second spring 84*b*, thus causing the second poppet valve 20 to move into the open position, as shown in FIG. 3A. When the second poppet valve 20 is in the open position (and the first poppet valve 18 is maintained in the closed position as described above), pressurized fluid from the supply 32 expands into the first module central passage 90, through the first actuator pneumatic line 134, and into the first cylinder volume 24. The pressure within the first cylinder volume 24 acts on a surface of the piston 62, resulting in a force on the piston 62 that is greater than the opposing force provided by the actuator spring 122. Consequently, the piston 62 and the attached actuator arm 120 are displaced towards the second end 124 of the body 118.

When the pilot valve 58 is in the second position (the energized state), as shown in FIG. 3B, pressure may be provided by the pilot valve 58 to the shuttle valve 60 to move the internal shuttle (not shown) to the second position in the manner previously described. In this second position of the pilot valve 58, the second poppet port 38*b* may be in fluid communication with the pilot supply port 110. Consequently, pressurized fluid from the supply 32 may be fed into the second volume 36 of the second poppet valve 20, maintaining the second poppet valve 20 in the closed position, thus preventing pressure from the supply 32 from escaping from the first module supply volume 92 into the first module central passage 90. Also in this second position, the first poppet port 38*a* may be in fluid communication with the shuttle exhaust port 96, and the pressure within the first volume 34 of the first poppet valve 18 can vent to the atmosphere. Accordingly, the pressure in the first cylinder volume 24 may enter the first module central passage 90, and this pressure acts on a surface of the first valve plug 82*a*. Because only the first spring 84*a* maintains the first poppet valve 18 in the closed position, the force resulting from the pressure on the surface of the first valve plug 82*a* may be greater than the force provided by the first spring 84*a*, causing the first poppet valve 18 to open. When the first poppet valve 18 is in the open position (and the second poppet valve 20 is in the closed position), the pressure in the first cylinder volume 24 vents through the first module exhaust port 28. The resulting decrease in pressure in the first cylinder volume 24 also results in a corresponding decrease in pressure on the piston 62, causing the actuator spring 122 to displace the piston 62 and the actuator arm 120 towards the first end 126 of the body.

One having ordinary skill in the art would recognize that, in the 3/2 configuration described above, the pneumatic actuator 26 can only be moved between two positions: a first position in which the actuator arm 120 is fully extended from the body 118 and a second position in which the actuator arm 120 is fully retracted into the body 118. One having ordinary skill in the art would additionally recognize that the 3/2 configuration described above may be achieved by other combinations of pilot and shuttle valves. For instance, the first poppet valve 18 may be operatively coupled to the pilot valve 58 instead of the shuttle valve 60, and the second poppet valve 20 may be operatively coupled to shuttle valve 60 instead of the pilot valve 58 to achieve 3/2 functionality.

When it is desired to achieve 5/2 functionality in the poppet valve assembly 10, both the first module 16 and the second module 42 may be disposed within the central bore 14 of the housing 12, as shown in FIGS. 4A and 4B. Again, the housing 12 has been omitted for clarity. A plurality of disk-like spacers (not shown) may be placed within the central bore 14 on either side of the first module 16 or the second module 42 to center and support the modules 16, 42. Instead of using the spring-loaded first embodiment of the pneumatic actuator 26, the second embodiment of the pneumatic actuator 26' having two cylinder ports 128, 130 may be used. The first cylinder port 128 of the pneumatic actuator 26' may be connected to the first module central port 22 by the first actuator pneumatic line 134 such that the first module central passage 90 is in fluid communication with the first cylinder volume 24 of the pneumatic actuator 26'. The second cylinder port 130 of the pneumatic actuator 26' may be connected to the second module central port 22' by a second actuator pneumatic line 140 such that the second module central passage 90' is in fluid communication with the second cylinder volume 48 of the pneumatic actuator 26'. The first poppet port 38*a* of the first module 16 may be connected to the shuttle work port 100 of the shuttle valve 60 by the first poppet pneumatic line 136*a*, as previously described. A fourth poppet pneumatic line 136*d* may connect the fourth poppet port 38*d* to the shuttle work port 100 of the shuttle valve 60. Additionally, the second poppet port 38*b* of the first module 16 may be connected to the pilot work port 116 of the pilot valve 58 by the second poppet pneumatic line 136*b*, as previously described. A third poppet pneumatic line 136*c* may connect the third poppet port 38*c* to the pilot work port 116 of the pilot valve 58. The first module supply port 30 of the first module 16 may be connected to the supply 32 by a first module supply pneumatic line 138 such that the supply 32 is in fluid communication with the first module supply volume 92. The second module supply port 30' of the second module 42 may be connected to the supply 32 by a second module supply pneumatic line 142 such that the supply 32 is in fluid communication with the second module supply volume 92'. The shuttle supply port 94 may be connected to the supply 32 by the shuttle supply pneumatic line 98, and the pilot supply pneumatic line 114 may connect the pilot supply port 110 to the supply 32.

When the pilot valve 58 is in the first position (the de-energized state), as shown in FIG. 4A, the pilot work port 116 may be in fluid communication with the pilot exhaust port 112, and no pressure is provided by the pilot 58 to move the shuttle 60 from the first position. In this first position, the first poppet port 38*a* may be in fluid communication with the shuttle work port 100. Consequently, pressurized fluid from the supply 32 may be fed into the first volume 34 of the first poppet valve 18, maintaining the first poppet valve 18 in the closed position. Also in this first position, the second poppet port 38*b* may be in fluid communication with the pilot exhaust port 112. Consequently, pressure within the second volume 36 of the second poppet valve 20 may vent to the atmosphere. Because only the second spring 84*b* maintains the second poppet valve 20 in the closed position, the pressure in the first module supply volume 92 acting on the second diaphragm 76*b* moves the second poppet valve 20 into the open position. When the second poppet valve 20 is in the open position (and the first poppet valve 18 is maintained in the closed position as described above), pressurized fluid from the supply 32 expands into the first module central passage 90, through the first actuator pneumatic line 134, and into the first cylinder volume 24. The pressure within the first cylinder volume 24 acts on the piston 62, moving the piston 62 and the attached actuator arm 120 towards the second end 124 of the body 118.

Also in the first position, as shown in FIG. 4A, the fourth poppet port 38*d* may be in fluid communication with the shuttle supply port 94. Consequently, pressurized fluid from the supply 32 is fed into the fourth volume 52 of the fourth poppet valve 46, maintaining the fourth poppet valve 46 in the closed position, thus preventing pressure from the supply 32 from escaping from the second module supply volume 92'. In this first pilot position, the third poppet port 38*c* may be in fluid communication with the pilot exhaust port 112. Consequently, pressure within the third volume 50 of the third poppet valve 44 may vent to the atmosphere. Accordingly, the pressure in the second cylinder volume 48 enters the second module central passage 90', and the pressure acts on the third valve plug 82*c*. Because only the third spring 84*c* maintains the third poppet valve 44 in the closed position, the pressure on the third valve plug 82*c* causes the third poppet valve 44 to open. When the third poppet valve 44 is in the open position (and the fourth poppet valve 46 is in the closed position), the pressure in the second cylinder volume 48 vents through the second module exhaust port 28'. The resulting decrease in pressure in the second cylinder volume 48 also results in a corresponding decrease in pressure on the piston 62, reducing the force opposing the movement of the piston 62 towards the second end 124 of the body 118.

When the pilot valve 58 is in the second pilot position (the energized state), as shown in FIG. 4B, pressure may be provided by the pilot valve 58 to the shuttle valve 60 to move the internal shuttle (not shown) to the second shuttle position in the manner previously described. In this second pilot position, the third poppet port 38*c* may be in fluid communication with the pilot pressure port 110. Consequently, pressurized fluid from the supply 32 is fed into the third volume 50 of the third poppet valve 44, maintaining the third poppet valve 44 in the closed position. Also in the second shuttle position, the fourth poppet port 38*d* is in fluid communication with the shuttle exhaust port 96 and pressure within the fourth volume 52 of the fourth poppet valve 46 vents to the atmosphere. Because only the fourth spring 84*d* maintains the fourth poppet valve 46 in the closed position, the pressure in the second module supply volume 92' acting on the fourth diaphragm 76*d* moves the fourth poppet valve 46 into the open position. When the fourth poppet valve 46 is in the open position (and the third poppet valve 44 is maintained in the closed position as described above), pressurized fluid from the supply 32 expands into the second module central passage 90', through the second actuator pneumatic line 140, and into the second cylinder volume 48. The pressure within the second cylinder volume 48 acts on the piston 62, moving the piston 62 and the attached actuator arm 120 towards the first end 126 of the body 118.

Also in the second pilot position, as shown in FIG. 4B, the second poppet port 38*b* is in fluid communication with the pilot work port 116. Consequently, pressurized fluid from the supply 32 is fed into the second volume 36 of the second poppet valve 20, maintaining the second poppet valve 20 in the closed position, thus preventing pressure from the supply 32 from escaping from the first module supply volume 92 into the first module central passage 90. In this second shuttle position, the first poppet port 38*a* is in fluid communication with the shuttle exhaust port 96. Consequently, pressure within the first volume 34 of the first poppet valve 18 may vent to the atmosphere. Accordingly, the pressure in the first cylinder volume 24 enters the first module central passage 90, and the pressure acts on the first valve plug 82*a*. Because only the first spring 84*a* maintains the first poppet valve 18 in the closed position, the pressure on the first valve plug 82*a* causes the first poppet valve 18 to open. When the first poppet valve 18 is in the open position (and the second poppet valve 20 is in the closed position), the pressure in the first cylinder volume 24 vents through the first module exhaust port 28. The resulting decrease in pressure in the first cylinder volume 24 also results in a corresponding decrease in pressure on the piston 62, reducing the force opposing the movement of the piston 62 towards the first end 126 of the body 118. In the 5/2 configuration (and in the 3/2 configuration previously described), the pneumatic actuator 26' can only be moved between two positions: a first position in which the actuator arm 120 is fully extended from the body 118, and a second position in which the actuator arm 120 is fully retracted into the body 118.

Figure 5A:
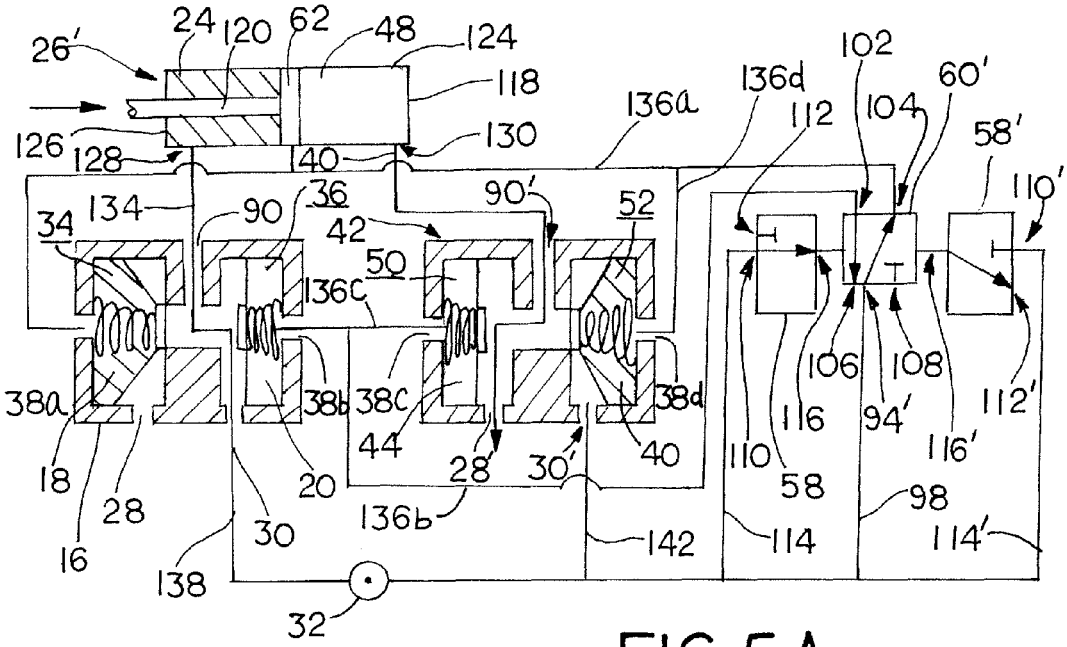
FIG. 5A is a schematic view of an embodiment of the poppet valve assembly having 5/2 "fail last" functionality wherein the first poppet valve of the first module and the fourth poppet valve of the second module are in the closed position and the second poppet valve of the first module and the third poppet valve of the second module are in the open position such that the actuator arm of the pneumatic actuator is retracted into the body of the pneumatic actuator.
Figure 5B:
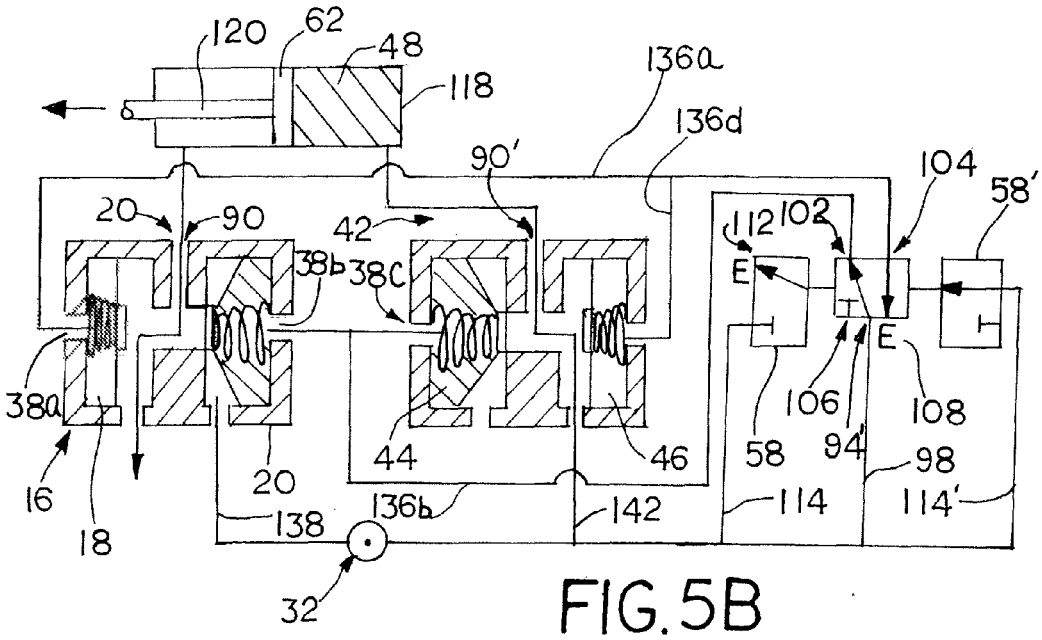
FIG. 5B is a schematic view of an embodiment of the poppet valve assembly having 5/2 "fail last" functionality wherein the first poppet valve of the first module and the fourth poppet valve of the second module are in the open position and the second poppet valve of the first module and the third poppet valve of the second module are in the closed position such that the actuator arm of the pneumatic actuator extends from the body of the pneumatic actuator.

When it is desired to achieve 5/2 "fail last" functionality in the poppet valve assembly 10, as shown in FIGS. 5A and 5B, the poppet valve assembly 10 may be configured for the standard 5/2 function, as described above, with two important modifications. First, instead of the 3/2 shuttle valve 60 used in the standard 5/2 configuration, the 5/2 shuttle valve 60' may be used. Second, the shuttle spring (not shown) may be removed, and a second pilot valve 58' may be added. The second poppet port 38*b* may be connected to the first shuttle work port 102 by the second poppet pneumatic line 136*b*, and the third poppet port 38*c* may be connected to the first shuttle work port 102 by the third poppet pneumatic line 136*c*. Additionally, the first poppet port 38*a* may be connected to the second shuttle work port 104 by the first poppet pneumatic line 136*a*, and the fourth poppet port 38*d* may be connected to the second shuttle work port 104 by a fourth poppet pneumatic line 136*d*. The first pilot supply port 110 of the first pilot valve 58 may be connected to the supply 32 by the first pilot supply pneumatic line 114, a second pilot supply port 110' of the second pilot valve 58' may be connected to the supply 32 by a second pilot supply pneumatic line 114', and the shuttle supply port 94 of the 5/2 shuttle 60' may be connected to the supply 32 by a shuttle supply pneumatic line 98. When the first pilot 58 is energized and the second pilot 58*b* is de-energized, as shown in FIG. 5A, the interior shuttle (not shown) of the shuttle valve 60' is moved to a first position in which the first poppet port 38*a* and the fourth poppet port 38*d* are in fluid communication with the shuttle supply port 94', and the second poppet port 38*b* and the third poppet port 38*c* are in fluid communication with the first shuttle exhaust port 106. In a manner that was previously explained, pressurized fluid enters the first cylinder volume 24 and is vented from the second cylinder volume 48, and the piston 62 and the attached actuator arm 120 are displaced towards the second end 124 of the cylinder body 118.

When the first pilot valve 58 is de-energized, as shown in FIG. 5B, the second pilot 58' is automatically energized, and the second pilot 58' moves the internal shuttle (not shown) of the shuttle valve 60' to a second position. In this second position, the first poppet port 38*a* and the fourth poppet port 38*d* are in fluid communication with the second shuttle exhaust port 108, and the second poppet port 38*b* and the third poppet port 38*c* are in fluid communication with the shuttle supply port 94'. In a manner that was previously explained, pressurized fluid enters the second cylinder volume 48 and is vented from the first cylinder volume 24, and the piston 62 and the attached actuator arm 120 are displaced towards the first end 126 of the cylinder body 118. When the first pilot 58 is again energized, as shown in FIG. 5A, the second pilot 58' is automatically de-energized, and the first pilot 58 moves the internal shuttle (not shown) to the first position. One having ordinary skill in the art would recognize that, in this configuration, the actuator arm 120 will remain in its last position if power is to the pilot valves 58, 58' is disrupted. As was the case with 5/2 functionality, the pneumatic actuator 26' can only be moved between two positions: a first position in which the actuator arm 120 is fully extended from the body 118 and a second position in which the actuator arm 120 is fully retracted into the body 118.

Figure 6A:
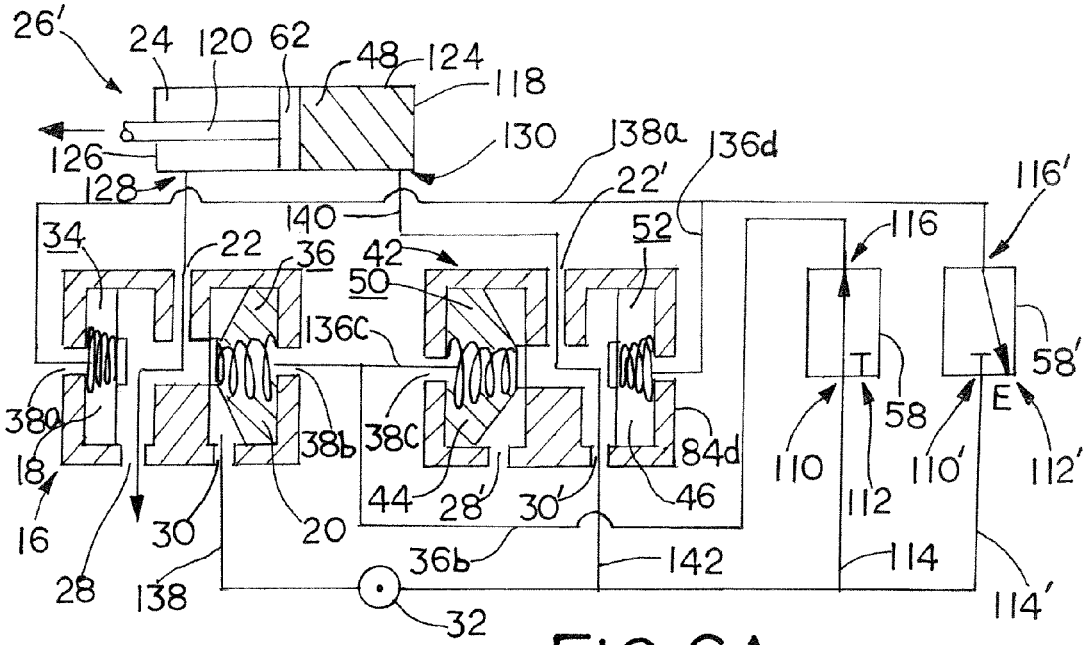
FIG. 6A is a schematic view of an embodiment of the poppet valve assembly having 5/3 "center block" functionality wherein the first poppet valve of the first module and the fourth poppet valve of the second module are in the open position and the second poppet valve of the first module and the third poppet valve of the second module are in the closed position such that the actuator arm of the pneumatic actuator extends from the body of the pneumatic actuator

When it is desired to achieve 5/3 "center block" functionality in the poppet valve assembly 10, as shown in FIGS. 5A and 5B, the poppet valve assembly 10 may be configured for the standard 5/2 function, as described above, with the exception that the shuttle valve 60 is not used. Instead of the shuttle valve 60, a second pilot 58' may be used with the first pilot 58. The second poppet port 38*b* may be connected to the first pilot work port 116 by the second poppet pneumatic line 136*b*, and the third poppet port 38*c* may be connected to the first pilot work port 116 by the third poppet pneumatic line 136*c*. Additionally, the first poppet port 38*a* may be connected to the second pilot work port 116' by the first poppet pneumatic line 136*a*, and the fourth poppet port 38*d* may be connected to the second pilot work port 116' by the fourth poppet pneumatic line 136*d*. The first pilot supply port 110 of the first pilot valve 58 may be connected to the supply 32 by the first pilot supply pneumatic line 114 and a second pilot supply port 110' of the second pilot valve 58' may be connected to the supply 32 by a second pilot supply pneumatic line 114'. When the first pilot 58 is de-energized and the second pilot 58' is energized, as shown in FIG. 6A, the second poppet port 38*b* and the third poppet port 38*c* may be in fluid communication with the first pilot supply port 110, and the first poppet port 38*a* and the fourth poppet port 38*d* may be in fluid communication with the second pilot exhaust port 112'. In a manner that was previously explained, pressurized fluid enters the second cylinder volume 48 and is vented from the first cylinder volume 24, and the piston 62 and the attached actuator arm 120 are displaced towards the first end 126 of the cylinder body 118.

Figure 6B:
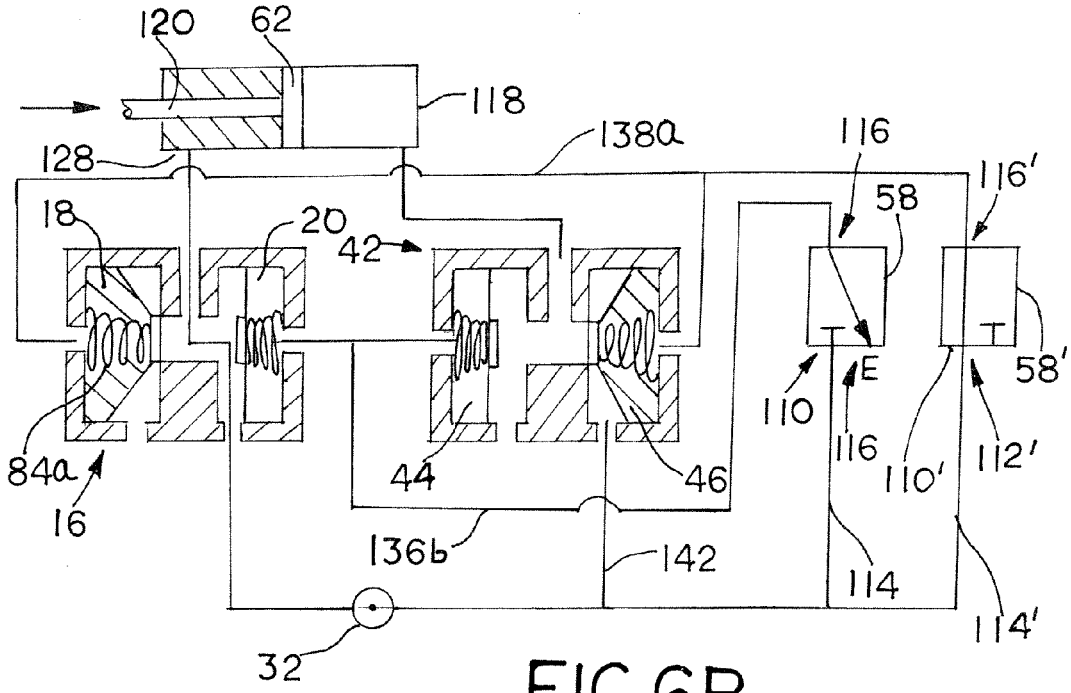
FIG. 6B is a schematic view of an embodiment of the poppet valve assembly having 5/3 "center block" functionality wherein the first poppet valve of the first module and the fourth poppet valve of the second module are in the closed position and the second poppet valve of the first module and the third poppet valve of the second module are in the open position such that the actuator arm of the pneumatic actuator retracts into the body of the pneumatic actuator.

When the first pilot 58 is energized and the second pilot 58' is de-energized, as shown in FIG. 6B, the second poppet port 38*b* and the third poppet port 38*c* are in fluid communication with the first pilot exhaust port 112, and the first poppet port 38*a* and the fourth poppet port 38*d* are in fluid communication with the second shuttle pilot port 110'. In a manner that was previously explained, pressurized fluid enters the first cylinder volume 24 and is vented from the second cylinder volume 48, and the piston 62 and the attached actuator arm 120 are displaced towards the second end 124 of the cylinder body 118.

Figure 6C:
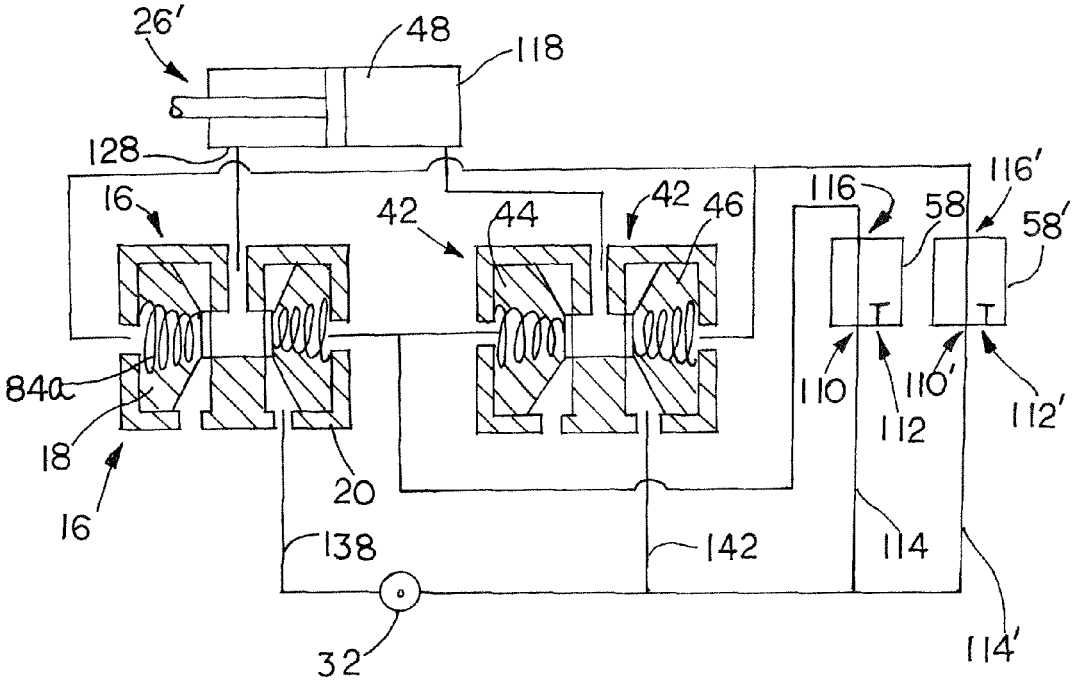
FIG. 6C is a schematic view of an embodiment of the poppet valve assembly having 5/3 "center block" functionality wherein the first poppet valve of the first module and the fourth poppet valve of the second module are in the closed position and the second poppet valve of the first module and the third poppet valve of the second module are in the closed position such that the actuator arm of the pneumatic actuator is maintained in its position.

When both the first pilot 58 and the second pilot 58' are de-energized (i.e., when both of the pilot work ports 116, 116' are in fluid communication with both of the pilot supply ports 110, 110') as shown in FIG. 6C, the second poppet port 38*b* and the third poppet port 38*c* are in fluid communication with the first pilot supply port 110, and the first poppet port 38*a* and the fourth poppet port 38*d* are in fluid communication with the second pilot supply port 110'. In this configuration, all of the poppet valves 18, 20, 44, 46 may be closed, preventing pressurized fluid from entering, or venting from, both the first cylinder volume 24 and the second cylinder volume 42. Thus, when both pilots 58, 58' are de-energized, the actuator arm 120 of the pneumatic actuator 26' "freezes," and can be maintained in any position between a first position in which the actuator arm 120 is fully extended from the body 118 and a second position in which the actuator arm 120 is fully retracted into the body 118.

When it is desired to achieve 5/3 "center exhaust" functionality (not shown in the figures), the poppet valve assembly 10 may be configured for the 5/3 "center block" functionality, as previously described. However, when both the first pilot 58 and the second pilot 58' are energized, both of the pilot work ports 116, 116' are in fluid communication with both of the pilot supply ports 110, 110'. Thus, when both pilots 58, 58' are energized, the actuator arm 120 of the pneumatic actuator 26' "freezes," and can be maintained in any position between a first position in which the actuator arm 120 is fully extended from the body 118 and a second position in which the actuator arm 120 is fully retracted into the body 118.

While various embodiments have been described above, this disclosure is not intended to be limited thereto. Variations can be made to the disclosed embodiments that are still within the scope of the appended claims. For example, the poppet ports may be connected to pilot valves or shuttle valves other than those disclosed. For instance, in the 5/3 "center block" configuration, the first poppet pneumatic line 136*a* may connect the first poppet port 38*a* to the first pilot work port 116 instead of the second pilot work port 116', the second poppet pneumatic line 136*b* may connect the second poppet port 38*b* to the second pilot work port 116' instead of the first pilot work port 116, the third poppet pneumatic line 136*c* may connect the third poppet port 38*c* to the second pilot work port 116' instead of the first pilot work port 116, and the fourth poppet pneumatic line 136*d* may connect the fourth poppet port 38*d* to the first pilot work port 116 instead of the second pilot work port 116'. Moreover, although a single supply 32 of pressurized fluid has been disclosed, the supply 32 of pressurized fluid may be comprised of several sources of pressurized fluid.

What is claimed is:

1. A poppet valve assembly comprising:

a valve housing having a central bore;

a first module disposed within the central bore, the first module comprising a first normally closed poppet valve and a second normally closed poppet valve, wherein each of the first and second normally closed poppet valves has an open position and a closed position;

a central port formed in the first module, wherein the central port of the first module is adapted to be coupled to a first volume of a pneumatic cylinder;

an exhaust port formed in the first module such that the central port is in fluid communication with the exhaust port when the first poppet valve is in the open position; and a supply port formed in the first module such that the central port is in fluid communication with the supply port when second poppet valve is in the open position, wherein the supply port is configured to be in fluid communication with a supply of pressurized fluid such that when the second poppet valve is in the open position, pressurized fluid is provided to the first volume of the pneumatic cylinder, and wherein the exhaust port is configured to vent pressurized fluid from the first volume of the pneumatic cylinder when the first poppet valve is in the open position, wherein the first normally closed poppet valve comprises a first volume and the second normally closed poppet valve comprises a second volume, wherein the first poppet valve comprises:

a first diaphragm circumferentially secured to the first module, the first diaphragm at least partially defining the first volume;

a first valve plug coupled to the first diaphragm; and a first valve seat formed in a first central aperture that is in fluid communication with a central passage, wherein a first spring disposed within the first volume biases the first valve plug into sealing engagement with the first valve seat such that the first poppet valve is normally closed, wherein said first spring is disposed between the first diaphragm and an inner wall of the first volume of said first module and wherein the second poppet valve comprises:

a second diaphragm circumferentially secured to the first module, the second diaphragm at least partially defining the second volume;

a second valve plug coupled to the second diaphragm; and a second valve seat formed in a second central aperture that is in fluid communication with the central passage, wherein a second spring disposed within the second volume biases the second valve plug into sealing engagement with the second valve seat such that the second poppet valve is normally closed, wherein said second spring is disposed between the second diaphragm and a second inner wall of the second volume of said first module, and wherein the first poppet valve is configured to be maintained in the closed position by a supply of pressurized fluid introduced into the first volume, and the second poppet valve is configured to be maintained in the closed position by a supply of pressurized fluid introduced into the second volume, and wherein at least one seal is disposed on an external surface of the first module surrounding the first volume, and at least one seal is disposed on the external surface of the first module surrounding the second volume, all of said seals sealingly contact the central bore.

2. The poppet valve assembly of claim 1, wherein a first poppet port is formed in the first module, the first poppet port being in fluid communication with the first volume and adapted to be both an inlet and an outlet for a pressurized fluid, and a second poppet port is formed in the first module, the second poppet port being in fluid communication with the second volume and adapted to be both an inlet and an outlet for a pressurized fluid.

3. The poppet valve assembly of claim 1, further comprising:

a second module disposed adjacent to the first module within the central bore, the second module comprising a third normally closed poppet valve and a fourth normally closed poppet valve;

a central port formed in the second module, wherein the central port of the second module is adapted to be coupled to a second volume within the pneumatic cylinder;

an exhaust port formed in the second module such that the central port of the second module is in fluid communication with the exhaust port of the second module when the third poppet valve is in an open position; and a supply port formed in the second module such that the central port of the second module is in fluid communication with the supply port of the second module when the fourth poppet valve is in an open position, wherein the supply port of the second module is configured to be in fluid communication with a supply of pressurized fluid such that when the fourth poppet valve is open, pressurized fluid is provided to the second volume within the pneumatic cylinder, and wherein the exhaust port of the second module is configured to vent pressurized fluid from the second volume within the pneumatic cylinder when the third poppet valve is open.

4. The poppet valve assembly of claim 3, wherein the third normally closed poppet valve comprises a third volume and the fourth normally closed poppet valve comprises a fourth volume.

5. The poppet valve assembly of claim 4, wherein the third poppet valve comprises:

a third diaphragm circumferentially secured to the second module, the third diaphragm at least partially defining the third volume;

a third valve plug coupled to the third diaphragm; and a third valve seat formed in a second central aperture that is in fluid communication with a central passage of the second module, wherein a third spring disposed within the third volume biases the third valve plug into sealing engagement with the third valve seat such that the third poppet valve is normally closed, and wherein the fourth poppet valve comprises:

a fourth diaphragm circumferentially secured to the second module, the fourth diaphragm at least partially defining the fourth volume;

a fourth valve plug coupled to the fourth diaphragm; and a fourth valve seat formed in a second central aperture that is in fluid communication with the central passage of the second module, wherein a fourth spring disposed within the fourth volume biases the fourth valve plug into sealing engagement with the fourth valve seat such that the fourth poppet valve is normally closed.

6. The poppet valve assembly of claim 3, wherein the first module and second module are both cylindrical and sized to be received into the central bore.

7. The poppet valve assembly of claim 1, wherein the central bore of the housing is cylindrical and wherein the first module is cylindrical and sized to be received into the cylindrical central bore.

8. A poppet valve assembly comprising:

a valve housing having a central bore;

a first module disposed within the central bore, wherein at least one seal is disposed on an external surface of the first module surrounding a first volume of the first module, and at least one seal is disposed on the external surface of the first module surrounding a second volume of the first module, all of said seals sealingly contact the central bore the first module comprising a first normally closed poppet valve and a second normally closed poppet valve, wherein each of the first and second normally closed poppet valves has an open position and a closed position, wherein a first spring is disposed between a first diaphragm and an inner wall of the first volume of said first module, and a second spring is disposed between a second diaphragm and a second inner wall of the second volume of said first module a central port formed in the first module, wherein the central port of the first module is adapted to be coupled to a first volume of a pneumatic cylinder;

an exhaust port formed in the first module such that the central port is in fluid communication with the exhaust port when the first poppet valve is in the open position; and a supply port formed in the first module such that the central port is in fluid communication with the supply port when second poppet valve is in the open position, wherein the supply port is configured to be in fluid communication with a supply of pressurized fluid such that when the second poppet valve is in the open position, pressurized fluid is provided to the first volume of the pneumatic cylinder, and wherein the exhaust port is configured to vent pressurized fluid from the first volume of the pneumatic cylinder when the first poppet valve is in the open position; and a second module disposed adjacent to the first module within the central bore, wherein, and wherein at least one seal is disposed on an external surface of the second module surrounding a third volume of the second module, and at least one seal is disposed on the external surface of the second module surrounding a fourth volume of the second module, all of said seals sealingly contact the central bore, the second module comprising a third normally closed poppet valve and a fourth normally closed poppet, wherein a third spring is disposed between a third diaphragm and a third inner wall of the third volume of said second module, and a fourth spring is disposed between a fourth diaphragm and a fourth inner wall of the fourth volume of said second module a central port formed in the second module, wherein the central port of the second module is adapted to be coupled to a second volume within the pneumatic cylinder;

an exhaust port formed in the second module such that the central port of the second module is in fluid communication with the exhaust port of the second module when the third poppet valve is in an open position; and a supply port formed in the second module such that the central port of the second module is in fluid communication with the supply port of the second module when the fourth poppet valve is in an open position, wherein the supply port of the second module is configured to be in fluid communication with a supply of pressurized fluid such that when the fourth poppet valve is open, pressurized fluid is provided to the second volume within the pneumatic cylinder, and wherein the exhaust port of the second module is configured to vent pressurized fluid from the second volume within the pneumatic cylinder when the third poppet valve is open.

9. The poppet valve assembly of claim 8, wherein the first normally closed poppet valve comprises the first volume and the second normally closed poppet valve comprises the second volume.

10. The poppet valve assembly of claim 9, wherein a first poppet port is formed in the first module, the first poppet port being in fluid communication with the first volume and adapted to be both an inlet and an outlet for a pressurized fluid, and a second poppet port is formed in the first module, the second poppet port being in fluid communication with the second volume and adapted to be both an inlet and an outlet for a pressurized fluid.

11. The poppet valve assembly of claim 9, wherein the first poppet valve comprises:

the first diaphragm circumferentially secured to the first module, the first diaphragm at least partially defining the first volume;

a first valve plug coupled to the first diaphragm; and a first valve seat formed in a first central aperture that is in fluid communication with a central passage of the first module, wherein the first spring disposed within the first volume biases the first valve plug into sealing engagement with the first valve seat such that the first poppet valve is normally closed, and wherein the second poppet valve comprises:

the second diaphragm circumferentially secured to the first module, the second diaphragm at least partially defining the second volume;

a second valve plug coupled to the second diaphragm; and a second valve seat formed in a second central aperture that is in fluid communication with the central passage, wherein the second spring disposed within the second volume biases the second valve plug into sealing engagement with the second valve seat such that the second poppet valve is normally closed.

12. The poppet valve assembly of claim 11, wherein the first poppet valve is configured to be maintained in the closed position by a supply of pressurized fluid introduced into the first volume, and the second poppet valve is configured to be maintained in the closed position by a supply of pressurized fluid introduced into the second volume.

13. The poppet valve assembly of claim 8, wherein the third normally closed poppet valve comprises the third volume and the fourth normally closed poppet valve comprises the fourth volume.

14. The poppet valve assembly of claim 13, wherein the third poppet valve comprises:

the third diaphragm circumferentially secured to the second module, the third diaphragm at least partially defining the third volume;

a third valve plug coupled to the third diaphragm; and a third valve seat formed in a second central aperture that is in fluid communication with a central passage of the second module, wherein the third spring disposed within the third volume biases the third valve plug into sealing engagement with the third valve seat such that the third poppet valve is normally closed, and wherein the fourth poppet valve comprises:

the fourth diaphragm circumferentially secured to the second module, the fourth diaphragm at least partially defining the fourth volume;

a fourth valve plug coupled to the fourth diaphragm; and a fourth valve seat formed in a second central aperture that is in fluid communication with the central passage of the second module, wherein the fourth spring disposed within the fourth volume biases the fourth valve plug into sealing engagement with the fourth valve seat such that the fourth poppet valve is normally closed.

15. The poppet valve assembly of claim 8, wherein the central bore of the housing is cylindrical and wherein the first module is cylindrical and sized to be received into the cylindrical central bore.

16. The poppet valve assembly of claim 8, wherein the first module and second module are both cylindrical and sized to be received into the central bore.

* * * * *